US011649027B2

(12) United States Patent
Basten

(10) Patent No.: US 11,649,027 B2
(45) Date of Patent: May 16, 2023

(54) ACCEPTOR DEVICE FOR OUTBOARD JET MOTORS

(71) Applicant: Waimed Enterprises, LLC, Lynchburg, VA (US)

(72) Inventor: Mason Basten, Lynchburg, VA (US)

(73) Assignee: WAIMED ENTERPRISES, LLC, Lynchburg, VA (US)

( * ) Notice: Subject to any disclaimer, the term of this patent is extended or adjusted under 35 U.S.C. 154(b) by 215 days.

(21) Appl. No.: 17/014,503

(22) Filed: Sep. 8, 2020

(65) Prior Publication Data

US 2021/0053662 A1 Feb. 25, 2021

Related U.S. Application Data

(63) Continuation-in-part of application No. 16/793,558, filed on Feb. 18, 2020, now abandoned, which is a continuation of application No. 15/618,820, filed on Jun. 9, 2017, now Pat. No. 10,618,619.

(60) Provisional application No. 62/376,962, filed on Aug. 19, 2016.

(51) Int. Cl.

| | |
|---|---|
| ***B63H 11/113*** | (2006.01) |
| ***B63H 20/02*** | (2006.01) |
| ***B63H 11/11*** | (2006.01) |

(52) U.S. Cl.

CPC ..... *B63H 11/113* (2013.01); *B63H 11/11* (2013.01); *B63H 20/02* (2013.01)

(58) Field of Classification Search

CPC ..... B63H 11/113; B63H 11/11; B63H 20/02
See application file for complete search history.

(56) References Cited

U.S. PATENT DOCUMENTS

| | | | | | |
|---|---|---|---|---|---|
| 3,040,695 | A * | 6/1962 | Austin | B63H 11/02 | 415/121.2 |
| 3,082,732 | A * | 3/1963 | Stallman | B63H 11/08 | 60/221 |
| 3,367,116 | A * | 2/1968 | Stallman | F01P 3/202 | 60/221 |
| 3,756,185 | A * | 9/1973 | Breslin | B63H 11/11 | 440/41 |
| 3,906,885 | A * | 9/1975 | Woodfill | B63H 11/113 | 440/43 |
| 4,775,341 | A * | 10/1988 | Tyler | B63B 1/16 | 60/221 |
| 5,254,023 | A * | 10/1993 | Kobayashi | B63H 11/10 | 440/38 |
| 5,437,568 | A * | 8/1995 | Kobayashi | B63H 11/117 | 440/38 |

(Continued)

*Primary Examiner* — S. Joseph Morano
*Assistant Examiner* — Jovon E Hayes
(74) *Attorney, Agent, or Firm* — New River Valley IP Law, P.C.; Michele L. Mayberry

(57) ABSTRACT

Described is an acceptor/adapter device for securing an outboard jet motor to a watercraft. The acceptor/adapter comprises a shrouded opening for communication with an intake of the outboard jet motor. Sidewalls of the acceptor/adapter device can form a tunnel, wherein the tunnel is configured for directing a flow of water through the tunnel, into the adapter/acceptor device, and into the intake of the outboard jet motor. Also described is a hull with a tunnel for directing a flow of water to an intake of an outboard jet motor, as well as a directional device which allows for vertical or horizontal adjustments to the jet output or reversing the jet output.

20 Claims, 25 Drawing Sheets

(56) References Cited

U.S. PATENT DOCUMENTS

| | | | | |
|---|---|---|---|---|
| 6,168,485 | B1 * | 1/2001 | Hall | B63H 20/245 440/89 R |
| 6,190,218 | B1 * | 2/2001 | Hall | B63H 1/16 440/89 R |
| 6,283,805 | B1 * | 9/2001 | Ishigaki | B63H 11/08 440/46 |
| 7,056,168 | B2 * | 6/2006 | Roos | B63H 20/10 440/38 |
| 7,217,165 | B2 * | 5/2007 | Roos | B63H 11/11 440/46 |
| 7,252,567 | B2 * | 8/2007 | Roos | B63H 11/04 440/38 |
| 2018/0050777 | A1 * | 2/2018 | Basten | B63H 11/113 |

* cited by examiner

ACCEPTOR DEVICE FOR OUTBOARD JET MOTORS

CROSS-REFERENCE TO RELATED APPLICATIONS

This application is a Continuation in Part application of U.S. application Ser. No. 16/793,558, filed Feb. 18, 2020, which is a Continuation application of parent application U.S. application Ser. No. 15/618,820, filed Jun. 9, 2017 (which issued as U.S. Pat. No. 10,618,619 on Apr. 14, 2020), and which parent application relies on the disclosure of and claims priority to and the benefit of the filing date of U.S. Provisional Application No. 62/376,962, filed Aug. 19, 2016. The disclosures of each of these applications are hereby incorporated by reference herein in their entireties.

FIELD OF THE INVENTION

The present disclosure relates to the field of boats. More particularly, the present disclosure relates to closed tunnel systems and directional devices for outboard jet motors on riverboats.

BACKGROUND OF THE INVENTION

Many watercraft employ outboard jet motors instead of the traditional propeller based motor. Boats employing jet motors have an advantage over propeller driven boats, particularly in shallow waters. Specifically, jet motors can be designed and/or mounted to the boat such that the jet motor provides sufficient propulsion to the boat but without the need for large portions of the motor to be submerged in the water as is the case with propeller driven motors. Generally, with outboard jet motors there is an intake submerged in the water that serves as the source through which water enters the motor. The intake typically consists of an opening covered by a grill or mesh functioning to prevent debris from entering the motor, and the intake is situated as the lowest part of the motor unit.

While watercraft employing jet motors have a distinct advantage over propeller driven boats in navigating shallow waters, typically the intake of an outboard jet motor still sits below the bottom of the hull of the boat, rendering it exposed to potential collisions. U.S. Pat. No. 5,437,568 discloses a watercraft having an inboard jet motor contained within a tunnel of the hull, where the inlet to the unit is flush with a bottom surface of the boat. Similarly, U.S. Pat. No. 6,283,805 discloses a jet propulsion outboard motor, yet the motor is flush with the bottom face of the ship body. A need exists for a hull which can support an outboard jet motor, mitigate damage to the motor when traveling in shallow waters, and operate efficiently.

SUMMARY OF THE INVENTION

The present disclosure provides a system of fitting an outboard jet motor on a boat, including an adapter to which the intake of the outboard jet motor can be fitted, a steering/trimming mechanism to direct the water exhaust stream, and a reversing mechanism to reverse the direction of such stream.

It is an object of the disclosure to provide a watercraft hull. The hull of the boat comprises a transom for receiving an outboard jet motor in a manner such that when installed the outboard jet motor is disposed in a fixed position and is restricted from rotating. Without more, the outboard jet motor disposed in a fixed position would not be capable of steering the boat. In communication with the hull is an adapter to which the outboard jet motor can be fitted, such that the intake of the outboard jet motor is in communication with the adapter at an opening disposed within the adapter. The hull further includes a tunnel disposed in a bottom surface of the hull shaped and sized for directing a flow of water into the intake of the outboard jet motor. The tunnel extends from a portion of the bottom surface of the hull to the adapter. It is a further object of the watercraft hull that the adapter is shaped and sized such that during use of the boat the adapter receives a flow of water from the tunnel and directs the flow of water into the intake of the outboard jet motor. Fixing the outboard jet motor in this way to the transom and the adapter will restrict rotation of the motor in any direction once mounted and maintain optimal flow of water into the intake.

It is another object of the disclosure that the adapter be disposed in communication with the rear of the tunnel to provide a mounting point for the intake of the outboard jet motor. Such configuration will protect the intake in shallow waters. It is a further object of the disclosure to provide an adapter that is capable of receiving the intake such that the intake can be fixed at an acute angle relative to the bottom of the hull of the boat for optimum intake efficiency when water flows through the tunnel, into the adapter, through the opening of the adapter, and into the intake of the outboard jet motor. Additional protection for the intake of the outboard jet motor can be provided by one or more bars that span the width of the adapter and/or tunnel and are positioned near and/or forward of the intake. Positioned in this manner, the bars can prevent large debris and/or structures, such as rocks, from coming into direct contact with the intake of the outboard jet motor. In embodiments, the bars can be provided by the jet pump of the motor.

It is yet another object of the disclosure to provide a directional mechanism for an outboard jet motor. The mechanism can include trim adjustment and/or steering components for an outboard jet motor. In one embodiment, the combination trim and steering component comprises a conduit for fitting around the outer diameter of the nozzle of the outboard motor and a pair of arms disposed on the conduit wherein one arm is mounted opposite the other arm. The mechanism further comprises a ring for performing trim adjustments and a steering nozzle. The trim ring is in communication with the pair of arms and the steering nozzle is in communication with the trim ring. The trim ring can be directed up and down and in combination with the steering nozzle can be used to make vertical adjustments to the jet output of the outboard jet motor. The steering nozzle can be directed left and right to make horizontal adjustments to the jet output.

The trim ring is disposed between the pair of arms and is capable of rotating on a first axis perpendicular to and through the pair of arms (rotates up-and-down) over a range of motion of about 90 degrees. The steering nozzle is in communication with the trim ring and is disposed between the trim ring and the conduit. The steering nozzle is shaped to receive the jet output from the nozzle of the outboard jet motor during use. The steering nozzle is in communication with the trim ring in a manner that provides for rotation of the steering nozzle on a second axis disposed perpendicular to the first axis over a range of motion of about 120 degrees. At least one actuator independently and selectively rotates the trim ring and the steering nozzle.

In another embodiment, the directional mechanism comprises an outer frame instead of the trim ring. The outer frame is disposed in communication with and joins the conduit and steering nozzle. A pair of axles is in communication with the outer frame and the conduit. The steering nozzle is configured to receive a flow of water from the jet nozzle by way of the conduit. The outer frame and steering nozzle are capable of rotating relative to the conduit along an axis defined by the pair of axles. In addition, the outer frame provides structure for connecting the directional mechanism to one or more actuators, which may be capable of moving the directional mechanism horizontally or vertically. Additionally, a second pair of axles may be in communication with the outer frame and the steering nozzle, such that the steering nozzle is capable of rotating relative to the outer frame along a second axis defined by the second pair of axles.

Further, it is an object of the directional mechanism to include a reversing component. The reversing component (otherwise referred to as a reversing bucket) may be raised or lowered from an open position to direct the watercraft into reverse (i.e., the "closed position"). During use, and when in the closed position, the reversing bucket is placed into the flow of the jet output to reverse the direction of the boat.

It is still yet another object of the disclosure to provide a watercraft comprising the hull and directional mechanism provided herein. The watercraft comprises an outboard jet motor having a water intake for receiving a flow of water and a nozzle for expelling the water in a manner sufficient to propel the watercraft. The watercraft has a transom for receiving the outboard jet motor in a manner such that the outboard jet motor is disposed in a fixed position and is restricted from rotating when installed. In communication with the hull is an adapter to which the outboard jet motor can be fitted, such that the intake of the outboard jet motor is in communication with the adapter at an opening disposed within the adapter. The hull further includes a tunnel disposed in a bottom surface of the hull shaped and sized for directing a flow of water into the intake of the outboard jet motor. The tunnel extends from a portion of the bottom surface of the hull to the adapter. It is a further object of the watercraft hull that the adapter is shaped and sized such that during use of the boat the adapter receives a flow of water from the tunnel and directs the flow of water into the intake of the outboard jet motor.

The watercraft further comprises a conduit for fitting around the outer diameter of the nozzle of the outboard motor and a pair of arms disposed on the conduit wherein one arm is mounted opposite the other arm. The mechanism further comprises a ring for performing trim adjustments and a steering nozzle. The trim ring is in communication with the pair of arms and the steering nozzle is in communication with the trim ring. The trim ring can be directed up and down and in combination with the steering nozzle can be used to make vertical adjustments to the jet output of the outboard jet motor. The steering nozzle can be directed left and right to make horizontal adjustments to the jet output. At least one actuator independently and selectively rotates the trim ring and the steering nozzle. The trim ring is disposed between the pair of arms and is capable of rotating on a first axis perpendicular to and through the pair of arms (rotates up-and-down) over a range of motion of about 90 degrees. The steering nozzle is in communication with the trim ring and is disposed between the trim ring and the conduit. The steering nozzle is shaped to receive the jet output from the nozzle of the outboard jet motor during use. The steering nozzle is in communication with the trim ring in a manner that provides for rotation of the steering nozzle on a second axis disposed perpendicular to the first axis over a range of motion of about 120 degrees. Alternatively, the watercraft may include a directional mechanism with the outer frame instead of the trim ring described above.

Another embodiment of the invention provides a boat hull which includes a transom for supporting an outboard jet motor, a tunnel disposed in a bottom surface of the hull and extending to the transom, and an adapter disposed where the transom and the tunnel meet. The adapter includes a shrouded opening for communication with the outboard jet motor at an intake of the outboard jet motor. The tunnel is configured for directing a flow of water through the tunnel, into the adapter, and into the intake of the outboard jet motor.

According to another embodiment, the tunnel of any Aspect or embodiment described herein can include a front end that merges with a bottom surface of the hull and a back end that terminates at the transom.

According to another embodiment, the tunnel of any Aspect or embodiment described herein can be configured to slope upwardly at an angle from the front end of the tunnel to the back end of the tunnel.

According to another embodiment, the tunnel of any Aspect or embodiment described herein can be configured to slope upwardly from the front end of the tunnel to the back end of the tunnel at an angle between about 5 degrees and about 45 degrees.

According to another embodiment, the depth of the tunnel of any Aspect or embodiment described herein can be configured to increase in depth from the front end of the tunnel to the back end of the tunnel.

According to another embodiment, the tunnel of any Aspect or embodiment described herein can have a width that is wider at the front end of the tunnel than at the back end of the tunnel.

According to another embodiment, the tunnel of any Aspect or embodiment described herein can include can be disposed on a centerline along the bottom surface of the hull.

According to another embodiment, the hull of any Aspect or embodiment described herein can be a modified V hull.

According to another embodiment, the adapter of any Aspect or embodiment described herein can comprise a plate in communication with the shrouded opening and the shrouded opening is disposed at an angle relative to the plate.

According to another embodiment, the intake of the outboard jet motor of any Aspect or embodiment described herein can be disposed in communication with the shrouded opening.

Another embodiment of the invention provides a directional device for an outboard jet motor of any Aspect or embodiment described herein which can include a conduit adapted to fit around a jet nozzle of an outboard jet motor a steering nozzle, an outer frame joining the conduit and the steering nozzle, and a first pair of axles in communication with the outer frame and the conduit. In this embodiment, the steering nozzle is configured to receive a flow of water from the jet nozzle by way of the conduit and the outer frame and the steering nozzle are capable of rotating relative to the conduit along a first axis defined by the first pair of axles.

According to another embodiment, the directional device of any Aspect or embodiment described herein can include at least one actuator capable of rotating the outer frame.

According to another embodiment, the at least one actuator of any Aspect or embodiment described herein can include a hydraulic actuator, an electric actuator, a mechanical actuator, a pneumatic actuator, or a combination thereof.

According to another embodiment, the at least one actuator of any Aspect or embodiment described herein can be disposed in communication with the outer frame.

According to another embodiment, the directional device of any Aspect or embodiment described herein can include a second pair of axles in communication with the outer frame and the steering nozzle. In this embodiment, the steering nozzle is capable of rotating relative to the outer frame along a second axis defined by the second pair of axles.

According to another embodiment, the directional device of any Aspect or embodiment described herein can include a reverse bucket in communication with the steering nozzle.

According to another embodiment, the reverse bucket of any Aspect or embodiment described herein can be configured to be disposed in an active position wherein the reverse bucket receives output from the steering nozzle, or in an inactive stowed position.

According to another embodiment, the directional device of any Aspect or embodiment described herein can include at least one actuator capable of positioning the reverse bucket in an active or inactive position.

According to another embodiment, the at least one actuator capable of positioning the reverse bucket of any Aspect or embodiment described herein can be a hydraulic actuator, an electric actuator, a mechanical actuator, a pneumatic actuator, or a combination thereof.

Another embodiment provides a boat of any Aspect or embodiment described herein that can include a boat hull and directional device described herein. The boat hull includes a transom for supporting an outboard jet motor, a tunnel disposed in a bottom surface of the hull and extending to the transom, and an adapter disposed where the transom and the tunnel meet. The adapter includes a shrouded opening for communication with the outboard jet motor at an intake of the outboard jet motor. The tunnel is configured for directing a flow of water through the tunnel, into the adapter, and into the intake of the outboard jet motor. The directional device includes a conduit adapted to fit around a jet nozzle of an outboard jet motor, a steering nozzle, an outer frame joining the conduit and the steering nozzle, and a first pair of axles in communication with the outer frame and the conduit. In this embodiment, the steering nozzle is configured to receive a flow of water from the jet nozzle by way of the conduit and the outer frame and the steering nozzle are capable of rotating relative to the conduit along a first axis defined by the first pair of axles.

Another embodiment of the invention provides a boat hull of any Aspect or embodiment described herein comprising a transom for supporting an outboard jet motor, a tunnel disposed in a bottom surface of the hull and extending to the transom, and an adapter disposed where the transom and the tunnel meet. The adapter comprises a shrouded opening for communication with the outboard jet motor at an intake of the outboard jet motor. The tunnel is configured for directing a flow of water through the tunnel, into the adapter, and into the intake of the outboard jet motor, and the adapter is configured to provide the outboard jet motor intake disposed at an angle that slopes upwardly toward the tunnel.

According to another embodiment, the tunnel of any Aspect or embodiment described herein can comprise a front end that merges with a bottom surface of the hull and a back end that terminates at the transom.

According to another embodiment, the tunnel of any Aspect or embodiment described herein can be configured to slope upwardly at an angle from the front end of the tunnel to the back end of the tunnel.

According to another embodiment, the tunnel of any Aspect or embodiment described herein can be configured to slope upwardly from the front end of the tunnel to the back end of the tunnel at an angle between about 5 degrees and about 45 degrees.

According to another embodiment, the depth of the tunnel of any Aspect or embodiment described herein can in depth from the front end of the tunnel to the back end of the tunnel.

According to another embodiment, the tunnel of any Aspect or embodiment described herein can have a width that is wider at the front end of the tunnel than at the back end of the tunnel.

According to another embodiment, the tunnel of any Aspect or embodiment described herein can be disposed on a centerline along the bottom surface of the hull.

According to another embodiment, the adapter of any Aspect or embodiment described herein can comprise a plate in communication with the shrouded opening and the shrouded opening is disposed at an angle relative to the plate.

According to another embodiment, the intake of the outboard jet motor of any Aspect or embodiment described herein can be disposed in communication with the shrouded opening.

Another embodiment provides a boat hull of any Aspect or embodiment described herein comprising a transom for supporting an outboard jet motor, a tunnel disposed in a bottom surface of the hull, the tunnel sloping upwardly at an angle toward the transom, and an adapter comprising a shrouded opening for communication with an intake of the outboard jet motor. The adapter is configured to provide the intake of the outboard jet motor at an angle that slopes upwardly toward the tunnel. The tunnel is configured for directing a flow of water through the tunnel, into the adapter, and into the intake of the outboard jet motor.

According to another embodiment, the tunnel of any Aspect or embodiment described herein can be configured to slope upwardly from the front end of the tunnel to the back end of the tunnel at an acute angle.

According to another embodiment, the tunnel shape and/or a cross section of the tunnel of any Aspect or embodiment described herein can be parabolic, U-shaped, trapezoidal, triangular, square, rectangular, pentagonal, hexagonal, or octagonal in shape.

According to another embodiment, the tunnel walls of any Aspect or embodiment described herein can be parallel to one another.

According to another embodiment, the tunnel walls of any Aspect or embodiment described herein can include can slope outwardly from the top of the tunnel to the bottom of the hull.

Another embodiment provides a boat hull of any Aspect or embodiment described herein comprising a modified V hull providing a tunnel in a bottom of the hull for flow of water, a transom for supporting an outboard jet motor, and an adapter disposed in a manner to provide a transition from the tunnel to the transom. The adapter comprises a shrouded opening for communication with the outboard jet motor at an intake of the outboard jet motor. The tunnel is configured for directing a flow of water through the tunnel, into the adapter, and into the intake of the outboard jet motor.

According to another embodiment, the tunnel of any Aspect or embodiment described herein can slope upwardly from a front end of the tunnel to a back end of the tunnel.

According to another embodiment, the tunnel of any Aspect or embodiment described herein can comprise walls that slope outwardly from a top of the tunnel to the bottom of the hull.

Additional embodiments of the invention include the Aspects identified herein.

Aspect 1 provides an acceptor device for securing an outboard jet motor to a watercraft, the acceptor device comprising one or more shrouded opening(s) shaped and sized for communication with an intake of one or more outboard jet motor(s), wherein the acceptor device is configured to provide the outboard jet motor intake disposed at an angle that slopes upwardly toward the watercraft.

Aspect 2 provides an acceptor device of any Aspect or embodiment described herein, wherein the acceptor device is secured to a transom or a surface on a bottom of the watercraft, or both.

Aspect 3 provides an acceptor device of any Aspect or embodiment described herein, wherein the acceptor device is configured to restrict movement of the intake of the outboard jet motor when the outboard jet motor is mounted/secured to the watercraft.

Aspect 4 provides an acceptor device of any Aspect or embodiment described herein, wherein the shrouded opening is configured for communication with a tunnel for directing a flow of water into the intake of the outboard jet motor during use.

Aspect 5 provides an acceptor device of any Aspect or embodiment described herein, wherein at least a portion of the tunnel is configured to be disposed under the watercraft.

Aspect 6 provides an acceptor device of any Aspect or embodiment described herein, wherein the tunnel is configured to be disposed behind the watercraft.

Aspect 7 provides an acceptor device of any Aspect or embodiment described herein, wherein the shrouded opening comprises one or more sidewalls shaped, sized, and disposed to cover gap(s) between the outboard jet motor and the acceptor device.

Aspect 8 provides an acceptor device of any Aspect or embodiment described herein, wherein the acceptor device is mounted to a bottom surface of the watercraft.

Aspect 9 provides an acceptor device of any Aspect or embodiment described herein, wherein the acceptor device is configured to elevate at least a portion of the intake of the outboard jet motor above a bottom surface of the watercraft.

Aspect 10 provides an acceptor device of any Aspect or embodiment described herein, comprising a first support configured to be mounted on an upper portion of a transom of the watercraft and a second support configured to be mounted on a lower portion of the transom, wherein during use the first support secures a top portion and the second support secures a bottom portion of the outboard jet motor to the watercraft.

Aspect 11 provides an acceptor device of any Aspect or embodiment described herein, which is provided as a single component or as two or more components.

Aspect 12 provides an acceptor device for securing an outboard jet motor to a watercraft, the acceptor device comprising one or more shrouded opening(s) shaped and sized for communication with an intake of one or more outboard jet motor(s) and for communication with a tunnel shaped and sized for directing a flow of water into the intake, wherein the acceptor device is configured to provide the outboard jet motor intake disposed at an angle that slopes upwardly toward the watercraft.

Aspect 13 provides an acceptor device of any Aspect or embodiment described herein, wherein a cross section of the tunnel is parabolic, U-shaped, trapezoidal, polygonal, triangular, square, rectangular, pentagonal, hexagonal, or octagonal.

Aspect 14 provides an acceptor device of any Aspect or embodiment described herein, wherein the tunnel is configured to slope upwardly from a first end to a second end of the tunnel.

Aspect 15 provides an acceptor device of any Aspect or embodiment described herein, wherein the tunnel has a depth that increases from the first end to the second end of the tunnel.

Aspect 16 provides an acceptor device of any Aspect or embodiment described herein, wherein the acceptor device is configured to be secured/mounted to a bottom surface of the watercraft.

Aspect 17 provides an acceptor device for securing an outboard jet motor to a watercraft, the acceptor device comprising one or more shrouded opening(s) shaped and sized for communication with an intake of one or more outboard jet motor(s) and comprising one or more sidewalls shaped, sized, and disposed in to cover gap(s) between the outboard jet motor and the acceptor device, wherein the acceptor device is configured to provide the intake of the outboard jet motor disposed at an angle that slopes upwardly toward the watercraft, and wherein the acceptor device is configured to elevate at least a portion of the intake of the outboard jet motor above a bottom surface of the watercraft.

Aspect 18 provides an acceptor device of any Aspect or embodiment described herein comprising a first support configured to be mounted on an upper portion of a transom of the watercraft and a second support configured to be mounted on a lower portion of the transom, wherein during use the first support secures a top portion and the second support secures a bottom portion of the outboard jet motor to the watercraft.

Aspect 19 provides an acceptor device of any Aspect or embodiment described herein, wherein the acceptor device is configured to receive a flow of water from a tunnel with a surface that slopes upwardly toward the intake of the outboard jet motor.

Aspect 20 provides an acceptor device of any Aspect or embodiment described herein, wherein the tunnel is configured to slope upwardly from a first end to a second end of the tunnel at an angle between 5 and 45 degrees.

DETAILED DESCRIPTION

Figure 1:
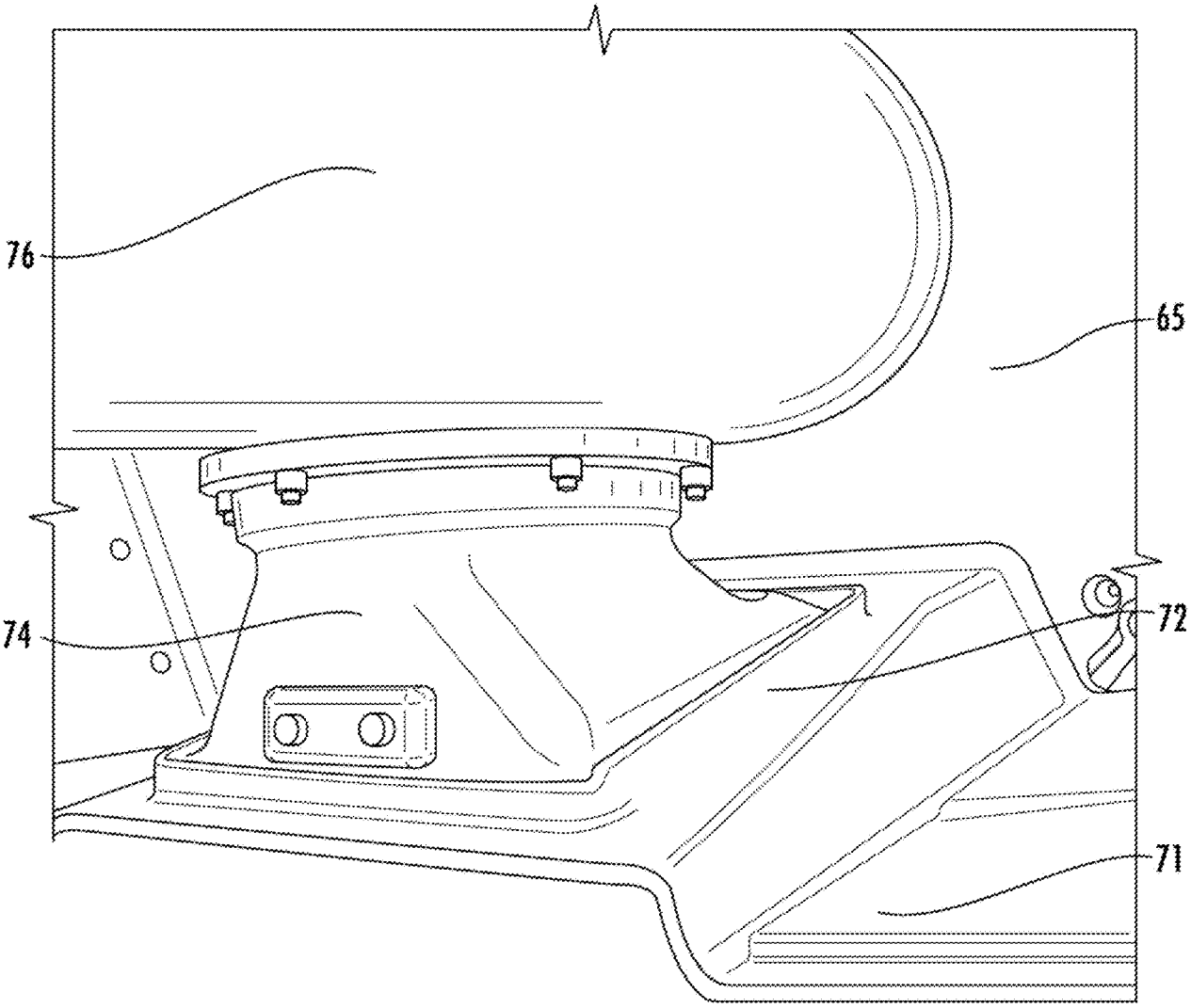
FIG. 1 is a drawing showing an outboard jet motor fitted/mounted onto an adapter of a boat.

In embodiments, the watercraft described herein comprises an outboard jet motor capable of being mounted to the watercraft in a fixed position such that the outboard motor does not rotate and a hull comprising a tunnel disposed in an underside of the hull for directing water into the intake of the outboard jet motor.

Hull

As provided throughout the specification, the term "hull" as used herein means the body or frame of a watercraft (e.g., a vessel, a boat, a ship, a waverunner, a jet ski, a kayak, a canoe, etc.). The hull may be any shape so long as it is buoyant and capable of supporting a motor, in particular, a jet motor. In embodiments, the hull will have a bow and a stern. In other embodiments, the hull may be fully enclosable and appropriately configured to safely accommodate passengers in a variety of conditions. Windows may be provided in the hull to allow the operator controlling the watercraft to steer it by visual guidance. As used herein, the term "bow" means the front portion of the watercraft (e.g., the forward section of the watercraft, the portion of the watercraft opposite the stern of the watercraft, etc.) and the term "stern" means the rear portion of the watercraft (e.g., the rear or aft sections of the watercraft, the portion of the watercraft opposite the bow, etc.). As used herein, the term "transom" means the portion of the watercraft where the hull terminates (e.g., the section of the watercraft where the stern terminates, etc.). Likewise, the terms "forward" and/or "forward section(s)" means approximately the front ⅓ of the watercraft's hull as measured from the bow. The terms "midship" and/or "amidship" means approximately the middle and/or second ⅓ of the watercraft's hull as measured from the bow. The terms "stern", "rear", "rear section(s)", "rear portion(s)", "aft", or "aft section(s)" refers to approximately the rearmost ⅓ of the watercraft's hull as measured from the bow.

As provided herein, the hull has a bottom (underside) surface and may be any shape so long as the hull is capable of supporting at least one outboard jet motor. Non-limiting examples of shapes suitable for the bottom surface of the hull include, molded, round-bilged, soft-chined, chined, hard-chined, or any other variation such as a semi-round-bilge, S-curve, V-bottom, multi-bottom, flat (i.e., two-chined) and so on. As used herein the terms "chine(s)" and/or "chined" means an angle in the hull (c.f., rounded bottoms). Hard chines indicate angle with little rounding whereas soft chines are rounded but involve the meeting of distinct planes.

In particular embodiments, the bottom surface of the hull is a two chine hull or a three chine hull. The hull may be either a hard chine or soft chine hull. In one aspect, the hull is a two chine (flat bottom) hull. In another aspect the hull is a three chine hull.

The bottom surface of the hull described herein may further comprise a tunnel (e.g., a channel). The tunnel can be any shape so long as the shape of the tunnel permits water to freely pass through it (e.g., parabolic, U-shaped, trapezoidal, polygonal, such as a triangular, square, rectangular, pentagonal, hexagonal, or octagonal in shape etc.). In particular aspects, the lateral cross sections of the tunnel form an area that is substantially rectangular or trapezoidal.

As provided herein, the tunnel comprises a recess sloping upwardly (e.g., an inclined posture) at an angle from the hull towards the stern where the recess is deepest. The tunnel has a front end that merges with the hull, a back end that terminates at the transom, and a middle section disposed between the front and back ends. Further, the tunnel has opposing walls extending from each side of the tunnel from the top of the tunnel to the bottom of the hull. The walls of the tunnel can be parallel to one another or sloped outwardly from the top of the tunnel to the bottom of the hull. The walls of the tunnel can be parallel to one another from the front end of the tunnel that merges with the hull to the transom or the walls of the tunnel can diverge from one another in this direction. The resulting void in the hull comprises the tunnel.

In particular embodiments, the tunnel slopes upwardly from the hull to the stern at an angle between about 0 degrees and about 60 degrees (e.g., 0 degrees, 1 degree, 2 degrees, 3 degrees, 4 degrees, 5 degrees, 6 degrees, 7 degrees, 8 degrees, 9 degrees, 10 degrees, 15 degrees, 20 degrees, 25 degrees, 30 degrees, 35 degrees, 40 degrees, 45 degrees, 50 degrees, 55 degrees, or 60 degrees). Unless otherwise specifically stated, as used herein, the term "about" is understood as within a range of normal tolerance in the art, for example within 2 standard deviations of the mean. The term "about" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

In a more particular aspect, the tunnel slopes upwardly from the hull to the stern at an angle between about 5 degrees and about 45 degrees. Further, the depth of the tunnel can vary depending on factors including, but not limited to, the length of the hull, the shape of the hull, the type of motor to be mounted to the hull, etc. In some aspects the depth of the tunnel at its deepest point can range between about 0.25 inches to about 48 inches (e.g., 0.25 inches, 0.50 inches, 0.75 inches, 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, 32 inches, 33 inches, 34 inches, 35 inches, 36 inches, 37 inches, 38 inches, 39 inches, 40 inches, 41 inches, 42 inches, 43 inches, 44 inches, 45 inches, 46 inches, 47 inches, 48 inches, and so on). In a particular aspect, the depth of the tunnel gradually increases from about 0 inches at the front end of the tunnel (i.e., where the tunnel merges with the hull) to a depth of about 18 inches at the back end of the tunnel (i.e., the transom). In embodiments, the depth of the tunnel can be about 10% to about 50% of the height of the hull.

In one aspect, the front and back ends of the tunnel may have the same width. In another aspect, the front and back ends of the tunnel may have different widths. In yet another aspect, the width of the tunnel increases gradually from the front end, where the width is the smallest, through the middle section, to the back end where the tunnel is the widest. In particular aspects, the width of the tunnel can range from about 6 inches to about 36 inches (e.g., 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, 32 inches, 33 inches, 34 inches, 35 inches, 36 inches, and so on). In one aspect, the width of the tunnel gradually increases from about 6 inches at the front end of the tunnel to about 18 inches at the back end of the tunnel. In embodiments, the width of the tunnel at the front end can be about 20% to about 100% of the width of the tunnel at the back end.

The tunnel, as described herein, may be disposed anywhere on the bottom surface of the hull. In particular aspects, the tunnel is disposed on a centerline along the bottom surface of the hull. In another aspect, the tunnel extends the entire length of the hull and is disposed on a centerline along the bottom surface of the hull. In a more particular aspect, the tunnel is disposed on a centerline extending from the middle section to the transom along the bottom surface of the hull. In a more particular aspect, the tunnel is disposed on a centerline extending from the midship portion of the hull (i.e., approximately the middle and/or second ⅓ of the watercraft's hull as measured from the bow) to the transom along the bottom surface of the hull. In still a more particular aspect, the tunnel is disposed on a centerline extending the entire length of the stern (i.e., approximately the rearmost ⅓ of the watercraft's hull as measured from the bow) along the bottom surface of the hull.

Transom

As provided herein, the transom may be any shape so long as the transom can support an outboard jet motor capable of propelling the watercraft. In particular aspects, the transom is recessed from the rear of the hull. The shape of the recess can be any shape (e.g., parabolic, U-shaped, trapezoidal, polygonal, such as a triangular, square, rectangular, pentagonal, hexagonal, or octagonal in shape etc.) so long as an outboard jet motor can be mounted on the watercraft. In embodiments, the outboard jet motor is mounted to the transom and preferably to a recessed transom. The tunnel, as described herein, may extend from the hull to the transom. The width of the recess in which the transom is disposed can be any distance, however, that distance may depend on a variety of factors including, but not limited to, the size of the motor to be installed on the watercraft, the number of motors to be installed on the watercraft, the size of the hull (e.g., length, width etc.), the type of motor to be installed on the watercraft etc. In one embodiment, the width of the recess in which the transom is disposed may range from between about 12 inches to about 60 inches (e.g., 12 inches, 13 inches, 14 inches, 15 inches, 16 inches, 17 inches, 18 inches, 19 inches, 20 inches, 21 inches, 22 inches, 23 inches, 24 inches, 25 inches, 26 inches, 27 inches, 28 inches, 29 inches, 30 inches, 31 inches, 32 inches, 33 inches, 34 inches, 35 inches, 36 inches, 37 inches, 38 inches, 39 inches, 40 inches, 41 inches, 42 inches, 43 inches, 44 inches, 45 inches, 46 inches, 47 inches, 48 inches, 49 inches, 50 inches, 51 inches, 52 inches, 53 inches, 54 inches, 55 inches, 56 inches, 57 inches, 58 inches, 59 inches, 60 inches and so on). In particular aspects, the recess in which the transom is disposed is substantially trapezoidal shaped when viewing the recess from behind the watercraft facing the bow.

In particular embodiments the system may further comprise an adapter disposed between and connecting the tunnel to an intake footer of an outboard jet motor. Such an adapter provides a fitting with which the intake of the outboard jet motor can be secured at the stern of the watercraft, in a manner such that water can flow from the tunnel, through the adapter, and into the intake of the outboard jet motor. The adapter may be installed during the manufacture of the hull or as an aftermarket modification. Where the adapter is installed as an aftermarket modification, the adapter may be secured using attachment methods known in the art. Non-limiting examples of attachment methods suitable for securing the adapter to the transom include welding, screwing, bolting, riveting, adhesives, tab-slot attachment systems, or any other fastening system.

As provided herein, the adapter comprises a solid plate and at least one opening shaped and sized for communication with the intake of an outboard jet motor. In embodiments, the number of openings provided in the plate corresponds to the number of motors to be installed onto the adapter, or one opening can be provided to accommodate more than one intake of a motor. The plate supports the one or more motors to be installed and further shields the motor and its constituent parts from impact by debris, rocks, shallow riverbeds, and other threatening objects. The plate can be any shape, however, the shape may be limited by the shape and design of the hull, the transom, and/or the recess in which the transom is disposed. In particular aspects, the adapter comprises a shrouded opening. The shrouded opening of the adapter can be shaped and sized to provide for a transition between the plate and the intake to the outboard jet motor. Preferably, the shrouded opening provides for a closed system capable of efficiently directing a flow of water from the tunnel, through the adapter, and into the intake of the outboard jet motor. For outboard motors with the intake disposed at an angle relative to the plate of the adapter, the shrouded opening comprises sidewalls shaped, sized and disposed in such a manner as to cover any gap that would be present between the intake of the motor and the plate as a result of the intake being disposed at an angle relative to the plate. The intake of the motor can be resting on the adapter, joined to the adapter, or otherwise disposed in a position enabling the intake to receive a flow of water through the adapter. Non-limiting methods suitable for securing the motor to the adapter, if desired, can include a gasket, welding, screwing, bolting, riveting, adhesives, tab-slot attachment systems, or any other fastening system.

Motor Mounting

Numerous configurations are possible for mounting a motor onto a watercraft. FIGS. 1-2 and 17-24, show a motor installed onto a boat. In FIGS. 1-2 and FIGS. 17-24, the outboard jet motor 76 is secured to the transom 65 in a fixed manner, such that once the motor 76 is fixed to the transom 65, the motor 76 does not move, tilt, or swivel as a typical outboard motor could be configured to do.

Figure 2:
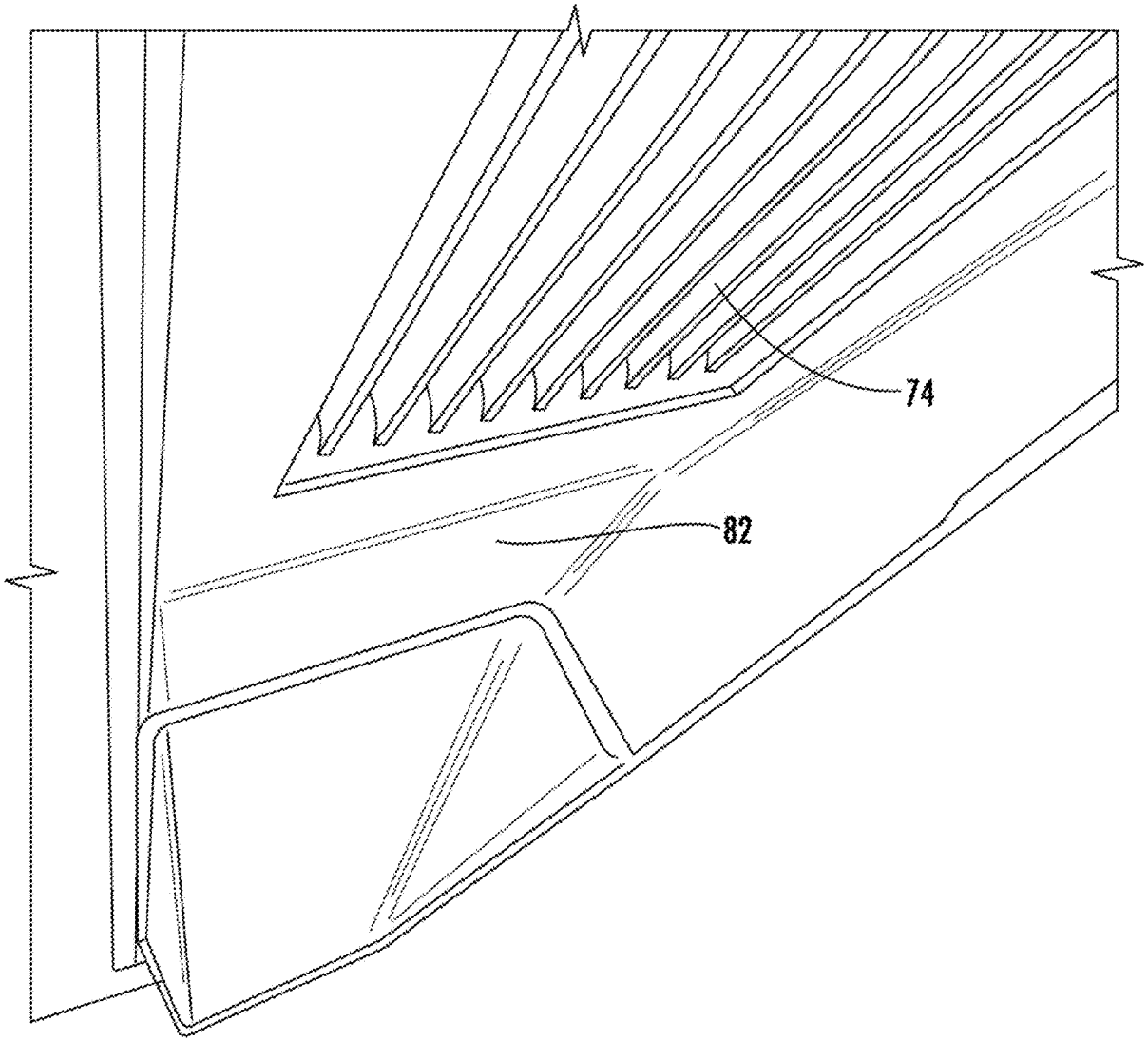
FIG. 2 is a drawing showing an outboard jet motor fitted/mounted onto the adapter shown in FIG. 1, which adapter is in communication with the tunnel of the hull, as viewed from the underside of the boat.

The outboard jet motor 76 can be mounted/secured to the boat in any conventional way. For example, the outboard jet motor 76 can be attached/mounted directly or indirectly to a transom 65. In FIGS. 1-2, the boat is 2-chined (i.e., a flat bottom boat) having a transom 65 and a tunnel 82 extending from the bottom of the hull to the transom 65 and to intake 74. As shown in FIGS. 1-2, the tunnel 82 can be disposed in the hull and extending past the transom 65 on the stern side of the transom 65. In FIGS. 17-24, tunnel 82 is offset such that tunnel 82 is disposed extending from the bottom of the hull past transom 65 on the stern side of transom 65. In embodiments, tunnel 82 can be formed from the hull of the boat and/or formed from adapter/acceptor device 71, and/or tunnel 82 can be disposed entirely in front of the transom (bow side of transom), or entirely behind the transom (stern side of transom), or partially in front of the transom and/or partially behind the transom.

The adapter/acceptor device 71 can be provided as a single piece or as a combination of multiple pieces, such as two pieces or more, and the pieces can be joined/fastened together and/or provided as independent components. In embodiments where the outboard jet motor 76 is mounted indirectly to the transom 65, the motor 76 can be joined such that it is in direct communication with an intermediate support structure (which can also be considered part of the adapter/acceptor device 71) and the intermediate support structure can be in direct communication with transom 65. For example, in FIGS. 18A, 18B and 22, a multi-piece adapter/acceptor device is labeled as 71-1 and 71-2. The adapter/acceptor device (71, 71-1, 71-2) can be mounted to the boat at any location, such as the hull, transom, rim/edge, etc., and by any conventional manner, such as by welding, screws, bolts, rivets, adhesives, tab-slot attachment systems, or any combination of these.

In these embodiments (FIGS. 1-2 and FIGS. 17-24), a transom 65 of a boat is configured to provide a space for fitting the acceptor device, such as adapter 71. In these embodiments, the adapter 71 is installed at the transom 65. The length of the tunnel 82 extends to the hole/opening 72 of the adapter 71. The opening 72 of the adapter 71 is shrouded (FIGS. 1 and 20) and can comprise one or more angled sidewalls 89 for mounting the outboard jet motor 76 at an angle relative to the plate. For outboard motors with the intake disposed at an angle relative to the plate or bottom portion of the adapter/acceptor device, the shrouded opening can comprise one or more sidewalls 89 shaped, sized and disposed in such a manner as to cover any gap(s) that would be present between the intake of the motor and the adapter/acceptor device as a result of the intake being disposed at an angle relative to the adapter/acceptor device. As provided in FIG. 1 and FIG. 20, one or more of the sidewalls 89 are angled such that when a jet motor 76 is installed, the plane of the water intake 74 is angled such that the intake 74 is facing the direction of water flow as it is passes through the tunnel 82 into the intake 74. The sidewalls are also configured to extend the tunnel 82 vertically to the intake 74 of the jet motor 76. As shown in FIGS. 1-2 and FIGS. 20-23, once the jet motor 76 is mounted onto the adapter 71, the water intake 74 is in communication with the opening 72 of the adapter 71 such that water is capable of flowing through the tunnel 82, through the opening 72 of the adapter 71, into the intake 74, and expelled from the nozzle of the jet motor 76. During use, typically the intake 74 of the jet motor 76 is stationary relative to the adapter 71, and does not change position as the motor is operating.

Figure 18A:
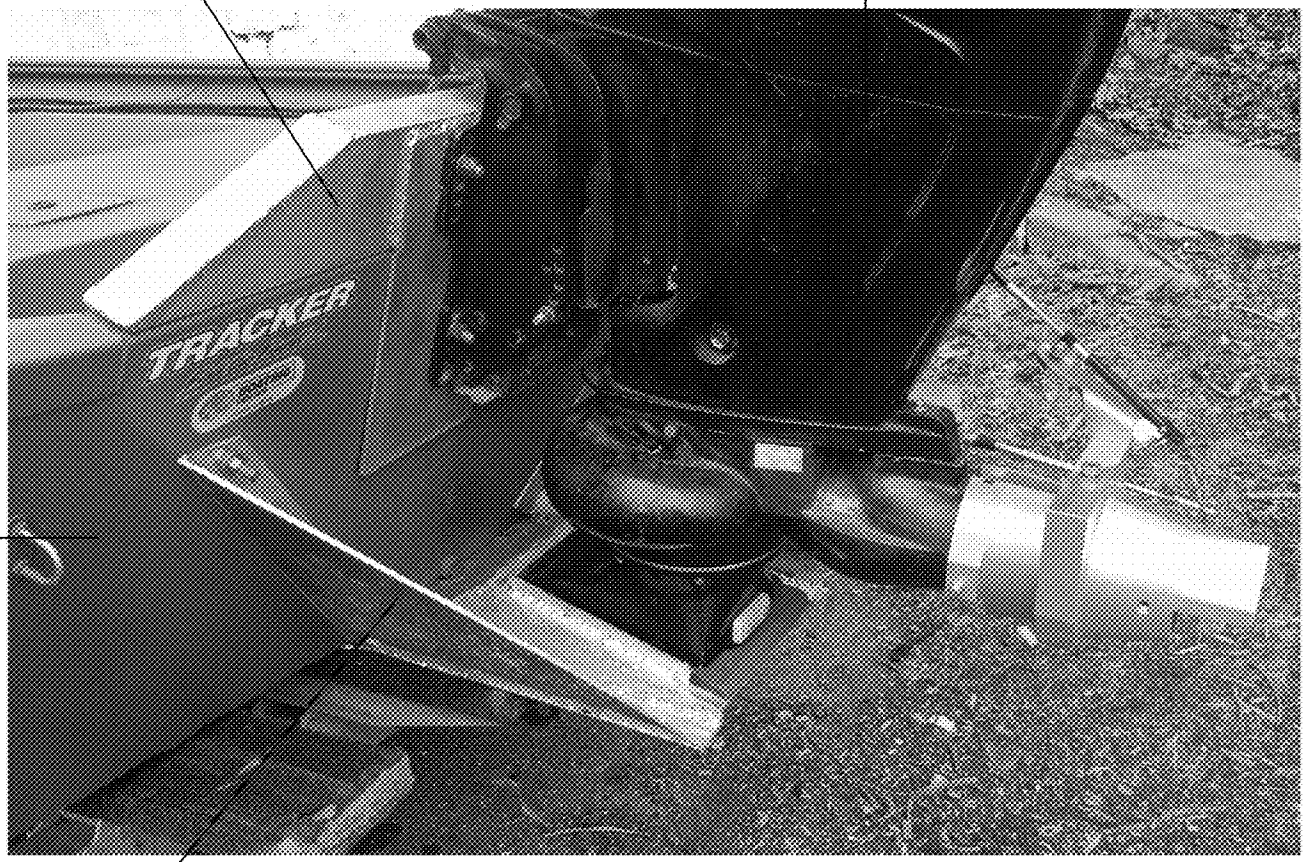
FIG. 18A is a drawing showing a perspective view of the acceptor device of FIG. 17 as described herein.
Figure 18B:
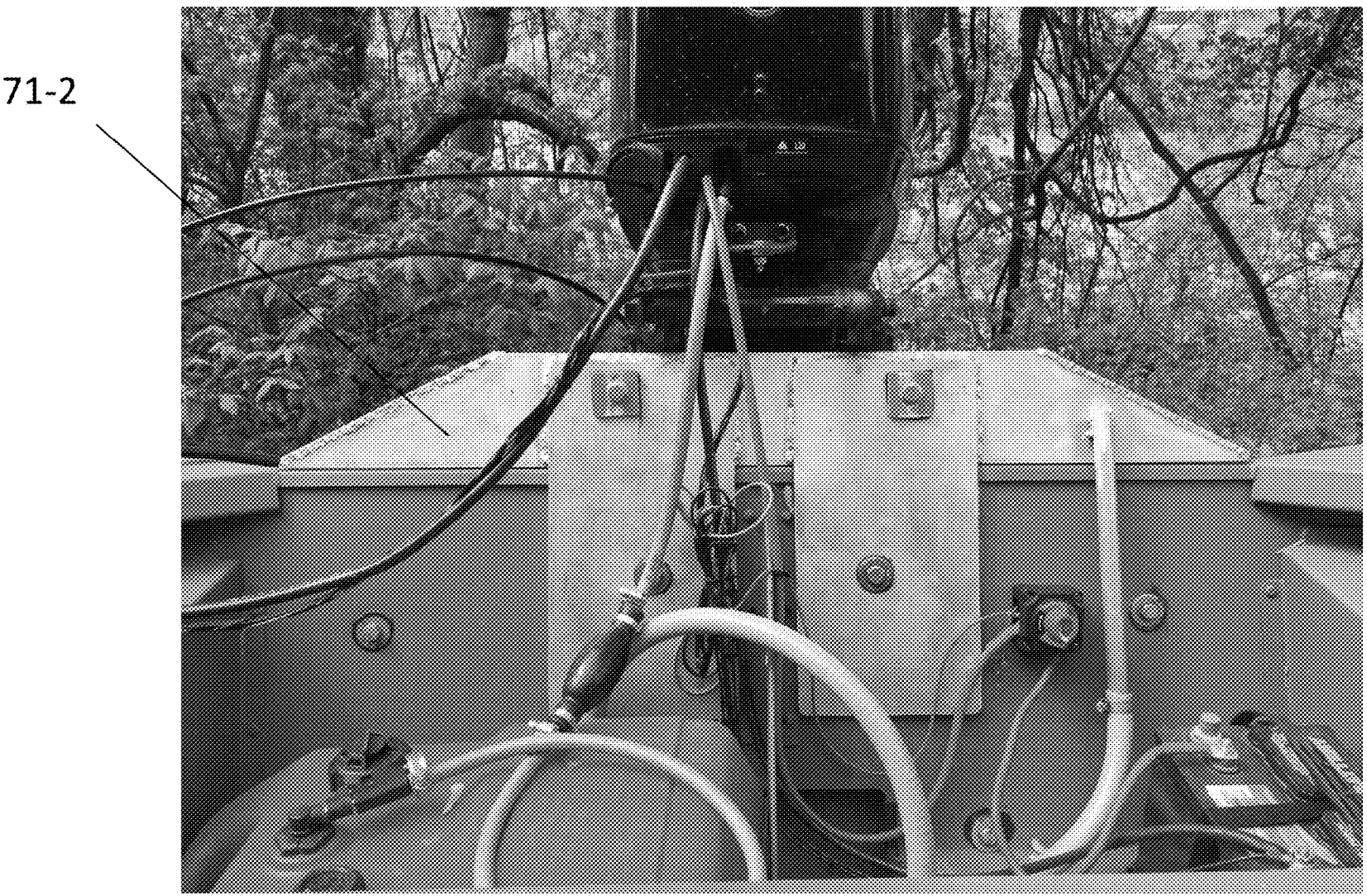
FIG. 18B is a drawing showing a front view of the acceptor device of FIG. 17 as described herein.
Figure 19:
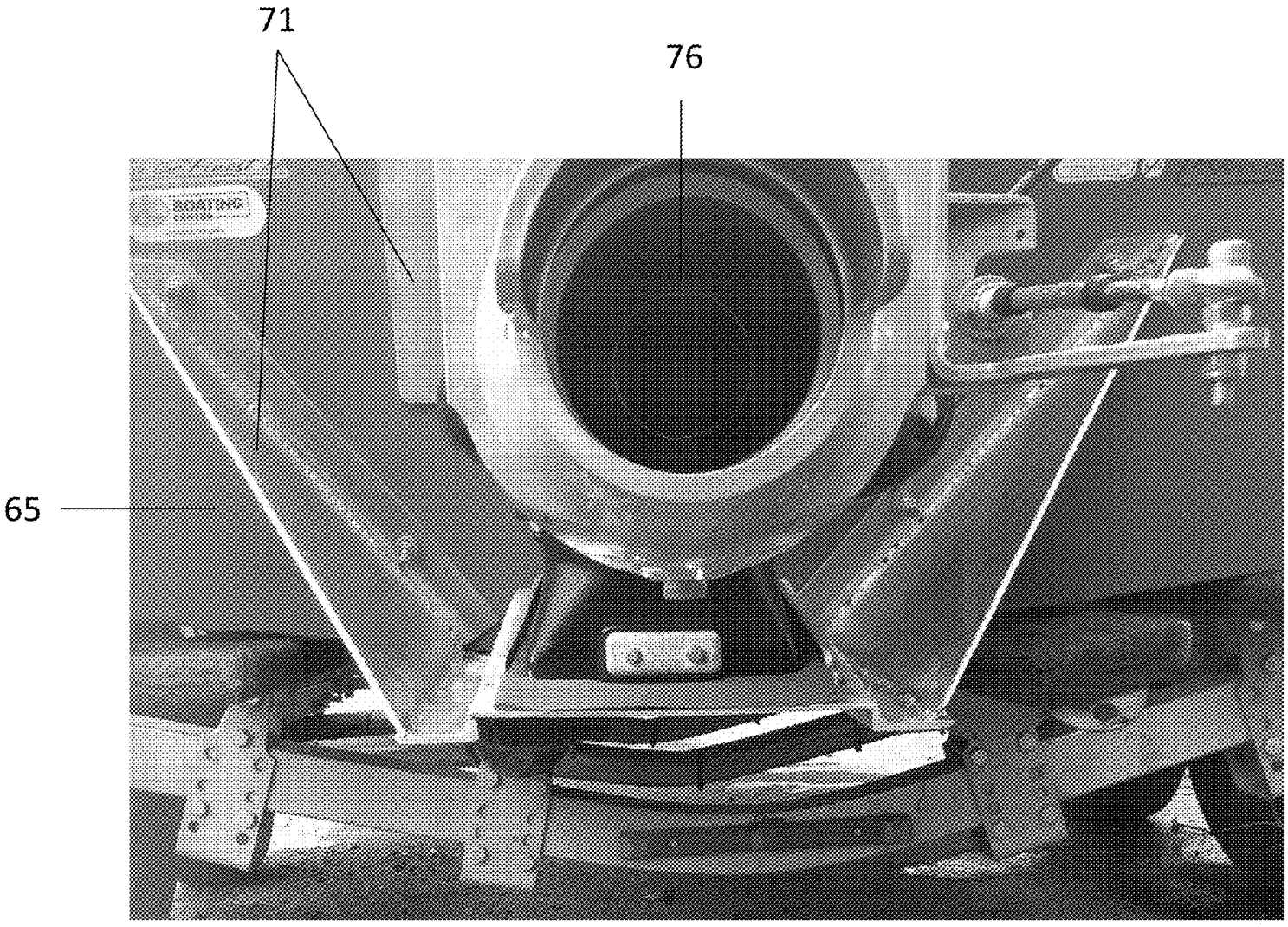
FIG. 19 is a drawing showing a rear view of an acceptor device configured to receive/mount/accommodate an outboard jet motor as described herein.
Figure 20:
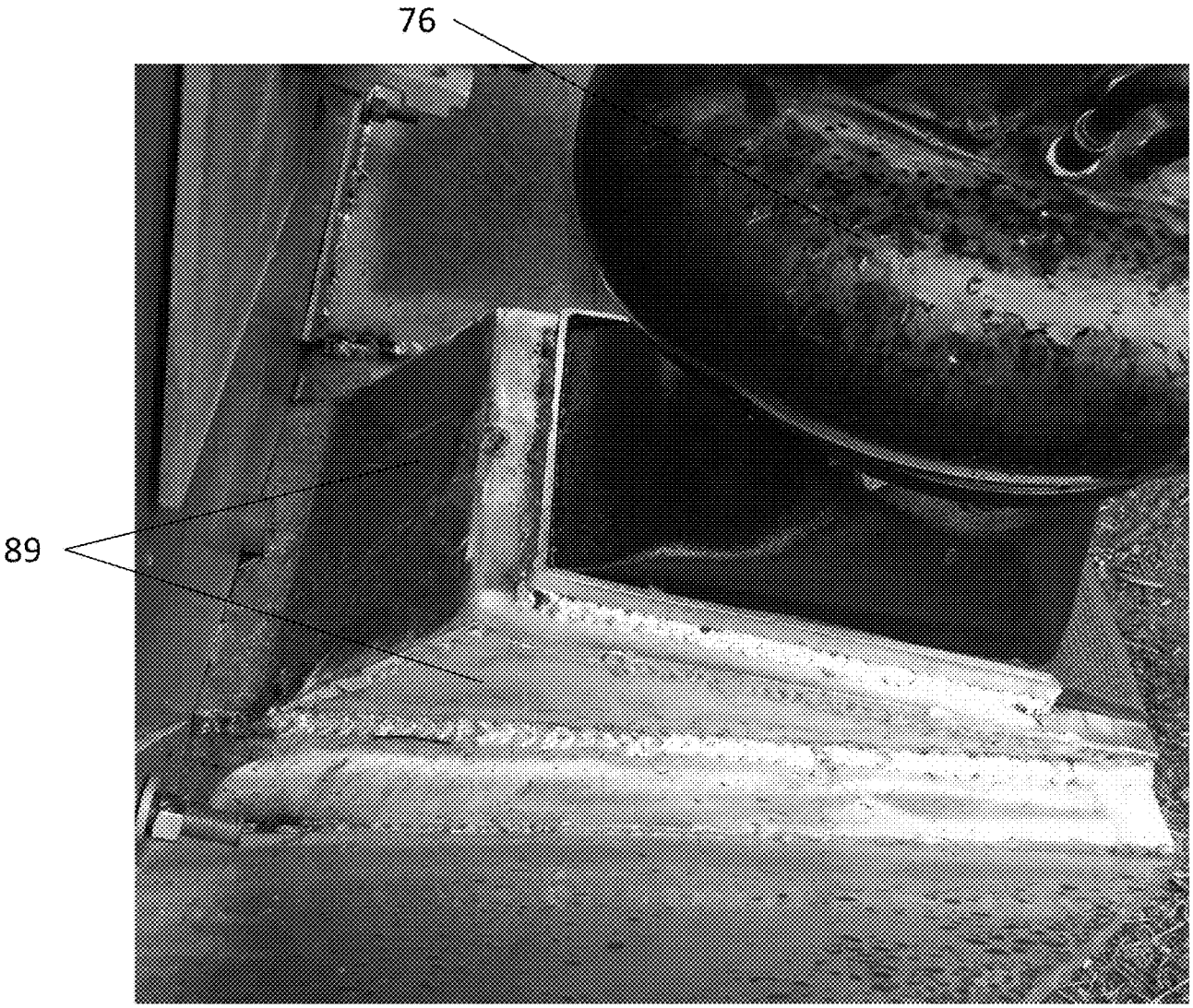
FIG. 20 is a drawing showing sidewalls of an acceptor device as described herein.
Figure 21:
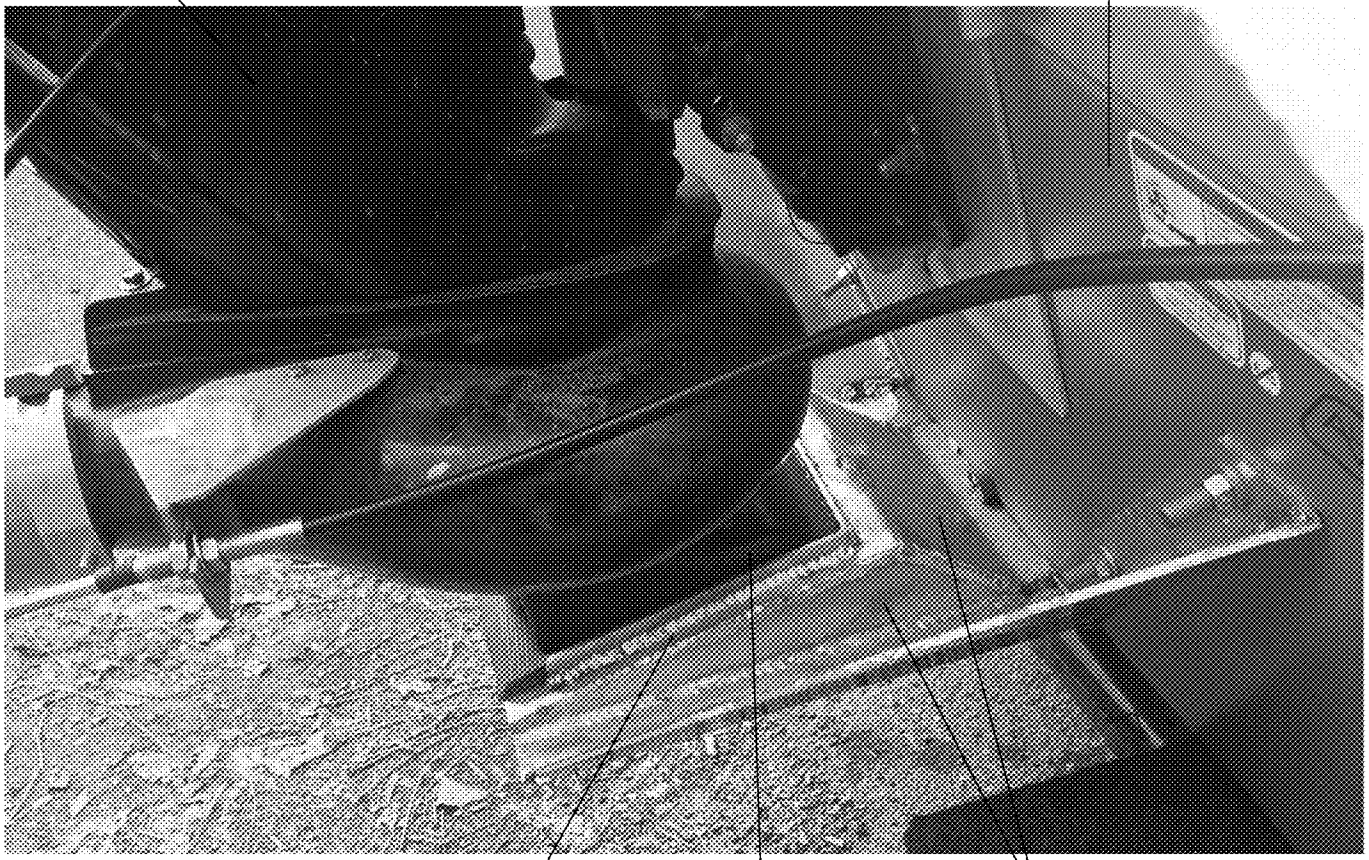
FIG. 21 is a drawing showing an intake of an outboard jet motor in communication with the shrouded opening of an acceptor device as described herein.
Figure 22:
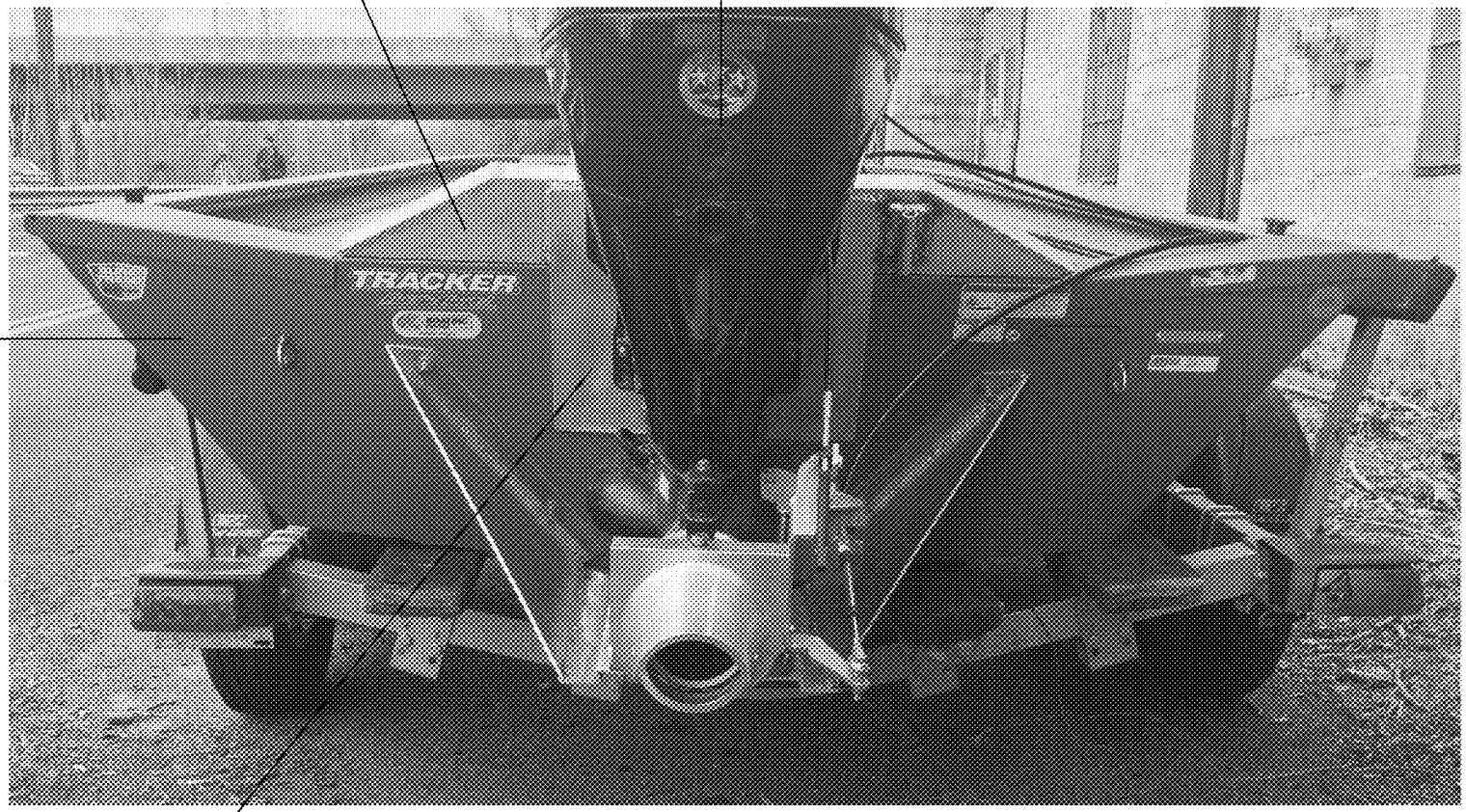
FIG. 22 is a drawing showing a rear perspective view of the acceptor device of FIG. 17 as described herein.

FIGS. 18A, 18B and 22 show an adapter/acceptor device 71 that comprises component 71-2 configured to rest along the top surface/rim/edge of the transom 65 and support an outboard jet motor 76, while component 71-1 is provided and configured to receive an intake of the outboard jet motor 74. As shown in FIG. 18B, component 71-2 can be mounted/secured to the hull by way of one or more support(s) disposed on either or both sides of the transom and/or secured with bolts extending through one or more of the support(s) and/or the transom.

Figure 23:
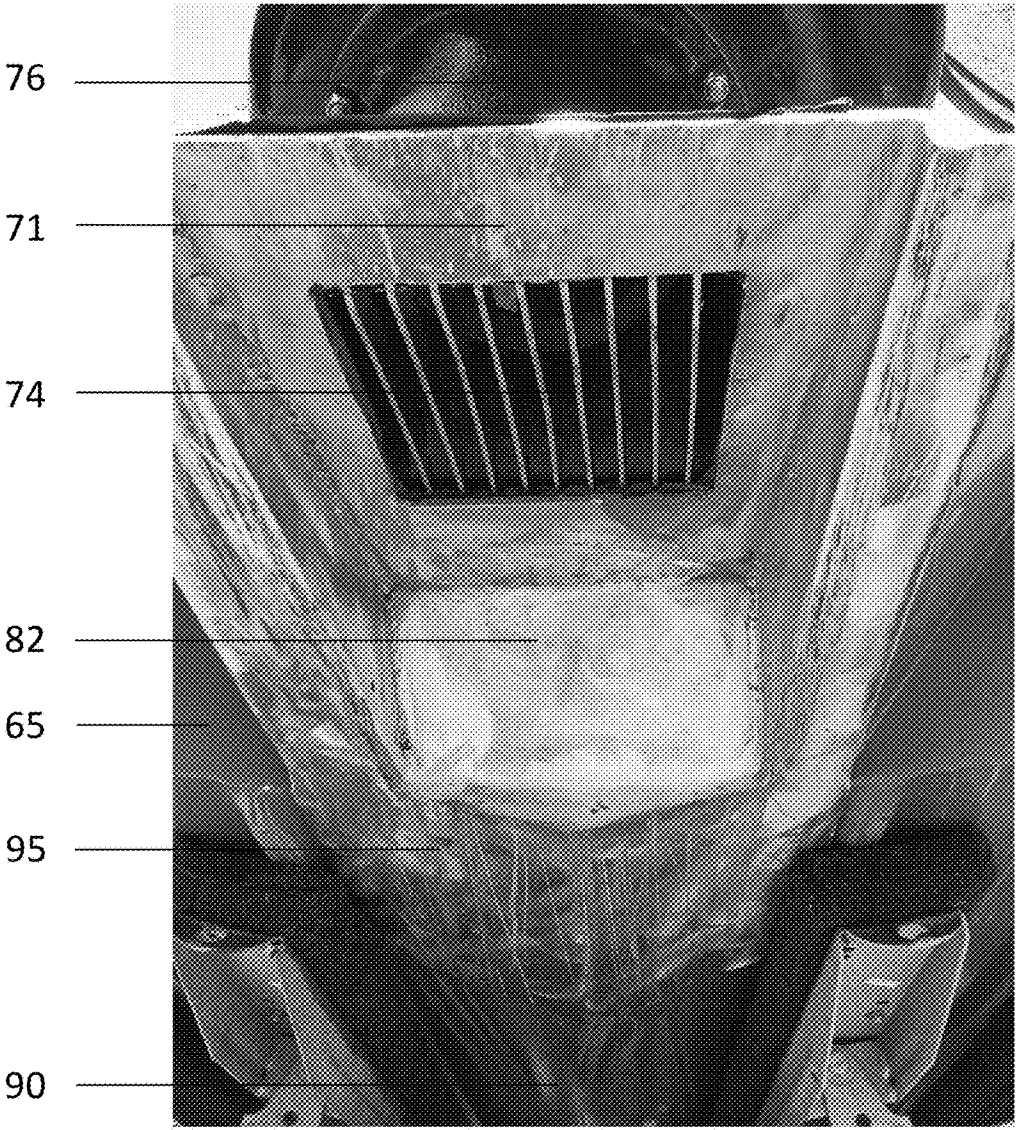
FIG. 23 is a drawing showing an outboard jet motor fitted/mounted to an acceptor device, the intake of an outboard jet motor in communication with the acceptor device, as viewed from the underside of the boat.
Figure 24:
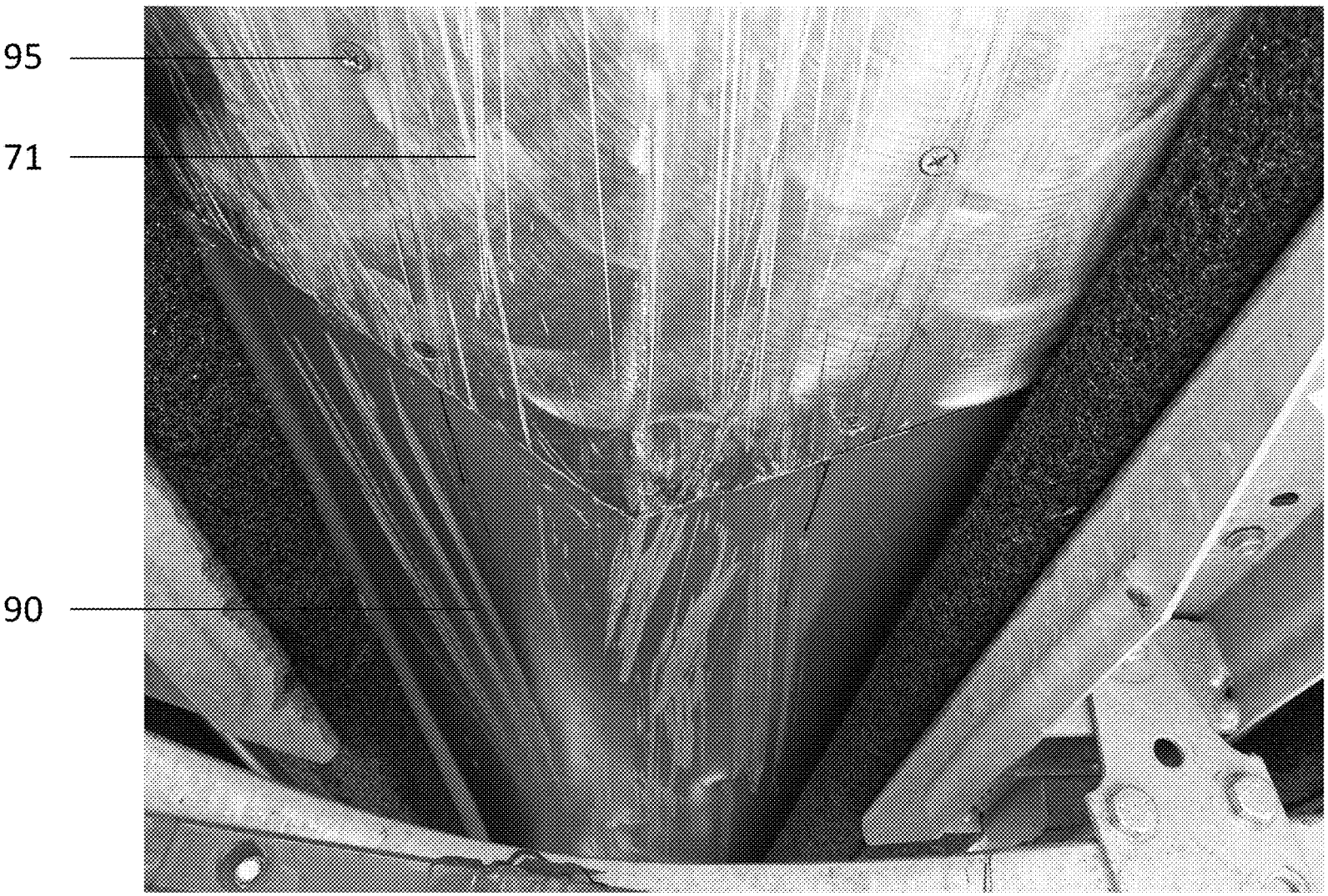
FIG. 24 is a drawing showing an acceptor device joined/mounted to a boat hull by way of one or more securing devices, such as screws, as viewed from the underside of the boat.

FIGS. 2 and 23 show an adapter/acceptor device 71 as viewed from the underside of the hull, FIGS. 1 and 22 show how/where the adapter/acceptor device 71 can be mounted to the boat, while FIG. 24 shows a close up of one way of securing the adapter/acceptor device 71 to the boat, here at the underside of the boat at the hull. While the adapter/acceptor device 71 can be mounted/secured to the hull by any conventional method, FIGS. 23 and 24 show the device mounted to the underside of the boat 90 using screws 95.

Directional Mechanism

Also provided herein is a directional mechanism or device for controlling the direction of watercrafts employing a jet motor (e.g., a pump-jet motor, hydrojet motor, or water jet motor) for propulsion. As described herein, a jet motor is any marine motor that creates a jet of water for propulsion. In particular, the directional mechanism is adapted for jet motors as described herein and provides for independent and selective manipulation of both steering and trim functions as well as reversing when the watercraft is operational. The directional mechanism may be installed during the manufacture of the motor or as an aftermarket modification to a motor. In particular embodiments, the directional mechanism is for aftermarket modification to a jet motor that is affixed to the nozzle of an outboard jet motor.

Figure 3:
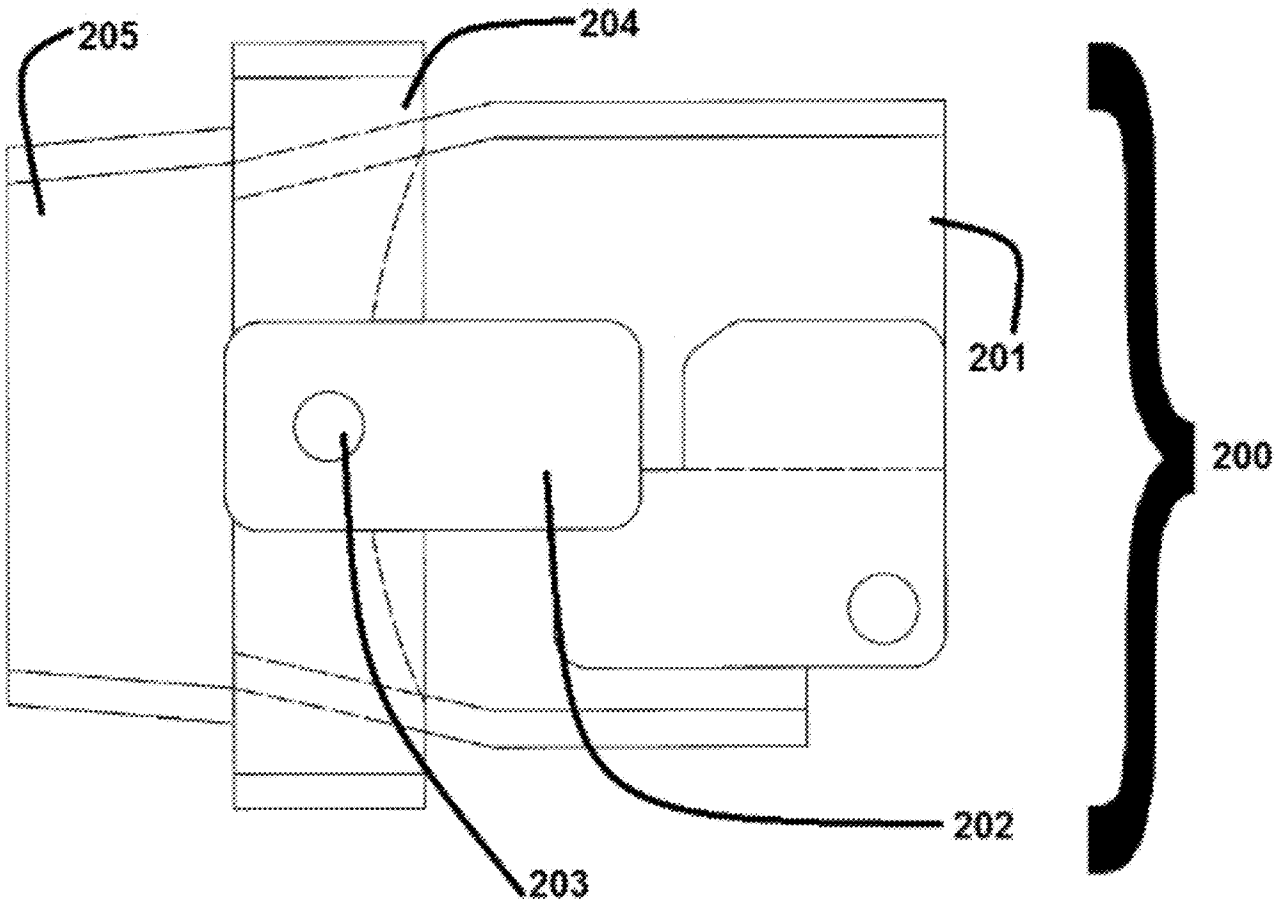
FIG. 3 is a schematic showing a side view of an embodiment of the steering and trim components of the directional mechanisms described herein.

As shown in FIG. 3, the directional mechanism 200 comprises a conduit 201 for fitting over the nozzle of an outboard jet motor and a trim/steering mechanism. The conduit may be any shape so long as it can be fit over the nozzle. Non-limiting examples of suitable cross-sectional shapes of the conduit include circular, oval, oblong, polygonal, such as a triangular, square, rectangular, pentagonal, hexagonal, or octagonal in shape etc. The conduit preferably has the same shape of the nozzle of the outboard jet motor, which is typically cylindrical. Methods for attaching the directional mechanism to the nozzle of the outboard jet motor are known in the art and include, but are not limited to, gaskets, welding, screwing, bolting, riveting, adhesives, tab-slot attachment systems, frictional engagement systems (e.g., compression rings), clamps (e.g., O-ring clamps), or any other fastening system.

In embodiments, the conduit has a cross-sectional shape that is substantially circular. In the particular embodiment provided in FIG. 3, the conduit 201 is a tube with a substantially circular cross-section. The diameter of the cross-section may depend on a variety of factors including, but not limited to, the diameter of the jet motor nozzle, the thickness of the conduit and/or nozzle, etc. In a particular aspect, the diameter of the conduit can range from about 1 inch to about 24 inches (e.g., 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, and so on). Additionally, the length of the conduit may vary and can range from about 1 inch to about 24 inches (e.g., 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, and so on).

Further, the directional mechanism 200 comprises two arms (e.g., a pair of arms) disposed on the conduit 201 to secure the trimming/steering mechanism to the directional mechanism. The arms 202 may be the same length or a different length so long as each arm has a length suitable for securing the trim and steering mechanisms to the conduit. In particular embodiments, the length of the arms can range from about 1 inch to about 24 inches (e.g., 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, 21 inches, 22 inches, 23 inches, 24 inches, and so on).

The pair of arms 202 may be positioned anywhere on the conduit 201 as long as the trim/steering mechanism is secured and functional when operational. In one embodiment, the two arms are disposed parallel to one another on the conduit, preferably on the outer surface of the conduit.

The arms 202 each further comprise at least one opening for receiving a first pair of axles 203 such as a pin, peg, or shaft. The first pair of axles 203 secures the trim/steering mechanism to the arms 202 of the conduit. The size of the openings will vary depending on the size and strength of the axles 203 necessary to secure the trim/steering mechanism to the arms of the conduit. The first pair of axles 203 may be any shape so long as the trim/steering mechanism is capable of pivoting about the first pair of axles 203 when coupled thereto.

Figure 4:
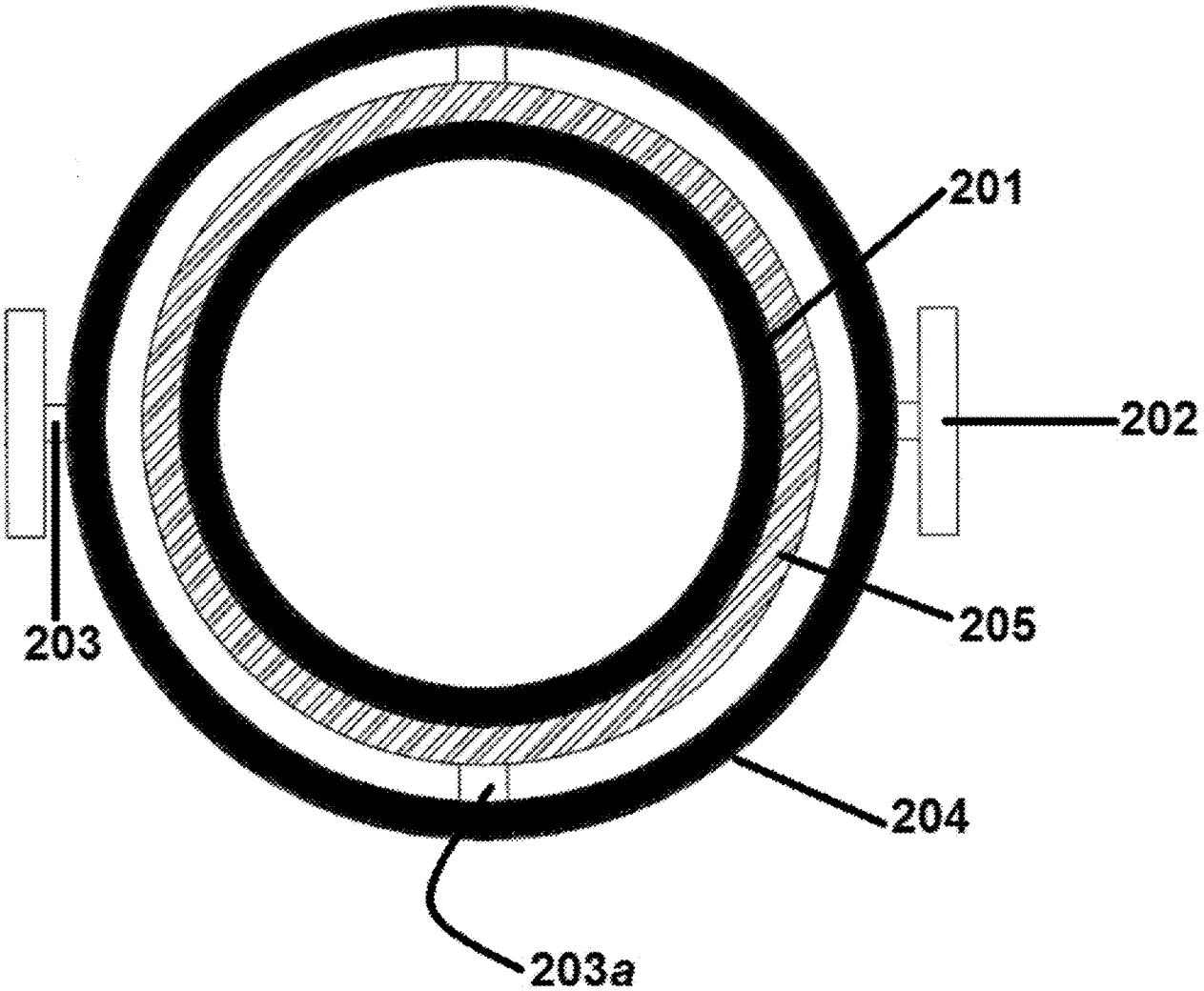
FIG. 4 is a schematic showing a cross-sectional view of an embodiment of the steering and trim components of the directional mechanisms as described herein.

As shown in FIGS. 3 and 4, the trim/steering mechanism is a multi-part mechanism and comprises at least a trim component 204 and a steering component 205. FIG. 4 illustrates that the trim component 204 is disposed on a first set of axles 203 and between the arms 202 attached to the conduit 201. The trim component can have any shape cross section, such as circular, oval, oblong, polygonal, triangular, square, rectangular, pentagonal, hexagonal, or octagonal etc., so long as the trim component has an inner diameter greater than the outer diameter of conduit 201. In particular embodiments, the trim component is a circular ring and the inner diameter of the trim ring ranges from about 1 inch to about 18 inches (e.g., 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, and so on). When the trim component is mounted on the first pair of axles 203, the trim component is capable of rotating on a first axis perpendicular to and through the pair of arms (rotates up-and-down) over a range of motion of about 90 degrees. The trim component further comprises openings for receiving a second pair of axles 203*a* for securing the steering component/nozzle 205 to the directional mechanism 200. In particular embodiments, the second pair of axles 203*a* are disposed in openings of the trim component perpendicularly to the first pair of axles 203. When mounted on the second pair of axles 203*a*, the steering nozzle 205 is in communication with the trim ring and is disposed between the trim ring and the conduit. The steering nozzle is shaped to receive the jet output from the nozzle of the outboard jet motor during use. The steering nozzle is in communication with the trim ring in a manner that provides for rotation of the steering nozzle on a second axis disposed perpendicular to the first axis over a range of motion of about 120 degrees. At least one actuator independently and selectively rotates the trim ring and the steering nozzle.

In one embodiment, the steering component comprises a funnel shaped tube (e.g., a steering nozzle) disposed on the second axles and surrounded by the housing of the trim component. When the steering nozzle is mounted on the second pair of axles, the steering nozzle is capable of rotating side-to-side about a vertical axis over a range of motion of about 120 degrees. The steering nozzle has a wider first end (i.e., the end of the steering nozzle in communication with the second pair of axles) for accepting water from the water jet nozzle of the outboard motor and a narrower second end through which the water jet exits the system. The inner diameter of the steering nozzle can be any diameter so long as the inner diameter is large enough to capture the flow of water exiting the jet nozzle of the outboard motor and the outer diameter is small enough to be surrounded by the trim ring. In a particular aspect, the outer diameter of the steering nozzle can range from about 1 inch to about 18 inches (e.g., 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, and so on) and the outer diameter of the nozzle intake can range from about 1 inch to about 18 inches (e.g., 1 inch, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, and so on). The inner diameter of the steering nozzle can be any diameter so long as it is a diameter less than the inner diameter of the nozzle intake.

In one embodiment, the trim/steering mechanism contains a fixed cylindrical conduit mounted around the jet nozzle of the outboard motor with two arms to serve as a mounting point for the steering/trim mechanism. In this embodiment, the steering/trim mechanism is comprised of a trim ring (i.e., the trim component) mounted between the inner surfaces of the arms to a first pair of axles to allow rotation of the trim ring about a horizontal axis. A concentric steering nozzle (i.e., the steering component) may be disposed inside the trim ring in a manner such that the steering nozzle is capable of rotating about a vertical axis, which vertical axis is perpendicular to the horizontal axis of the trim ring. Further, the steering nozzle may be attached to the trim ring about a vertical axis. The angle of the trim ring and the steering nozzle can be independently and selectively controlled about their respective axes by any means known in the art (e.g., an actuator, etc.), with the result being a directional mechanism that can rotate laterally, to provide steering ability, and vertically, to provide trimming ability.

The reversing component may be any mechanism capable of moving the watercraft in reverse (i.e., backwards). The reversing component, as described herein, is a device which rotates about a pivot and deflects the water exiting the jet nozzle of the outboard motor when pivoted into a position in the path of the jet stream. In a particular embodiment, the reversing component is a bucket disposed on the conduit and/or arms of the directional mechanism. The bucket can be any shape so long as it is sufficiently large enough in size to cover the jet nozzle. That is, the jet nozzle is completely covered by the reverse bucket when the bucket is in a downward or closed position. When the reverse bucket is in the closed (active) position the fluid flow through the jet nozzle is diverted in a direction that causes the watercraft to reverse direction. When the reverse bucket is in the open (inactive) position, the jet of water passes through the jet nozzle unimpeded and moves the watercraft forward. In particular embodiments, the reverse bucket can channel the jet into either a right channel or a left channel to permit steering of the watercraft when it is travelling in a reverse direction.

An embodiment of the reversing component may be a bucket shaped scoop. The reversing mechanism may be mounted on the conduit and/or arms by way of a pair of axles to allow rotation of the reversing component about a horizontal axis.

In particular embodiments, one or more actuators may be used to independently and selectively rotate the trimming, steering, and reversing components. In one aspect a single actuator controls the rotation of the trimming component, the steering component, and the reversing component. In another aspect the trimming, steering, and reversing components are controlled by multiple actuators. Non-limiting examples of actuators suitable for rotating the trimming and steering components include hydraulic actuators, electric actuators, mechanical actuators, pneumatic actuators, and combinations thereof.

Figure 5:
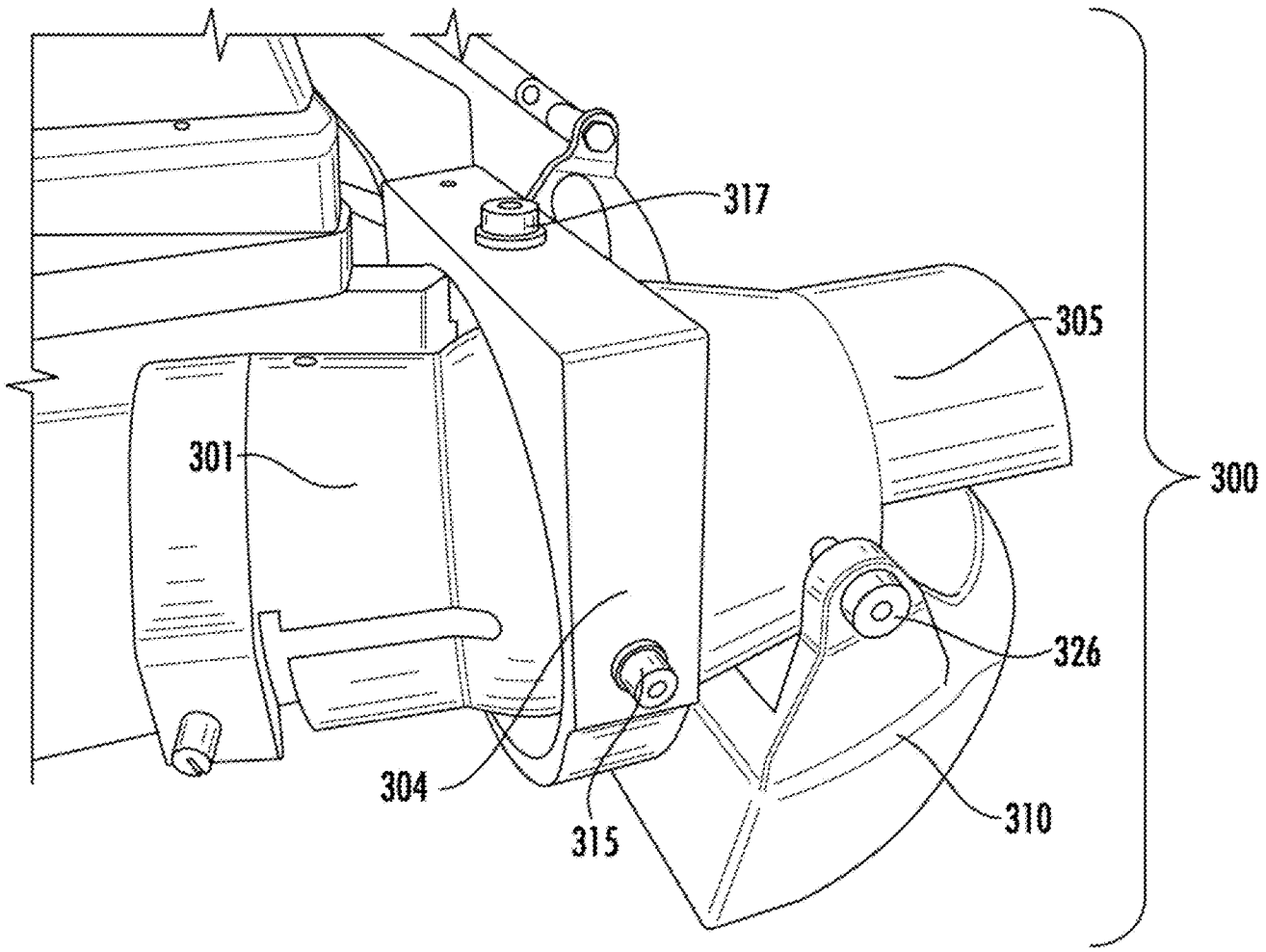
FIG. 5 is a drawing showing an embodiment of a directional mechanism as described herein, with the reversing bucket in an open, inactive position.
Figure 6:
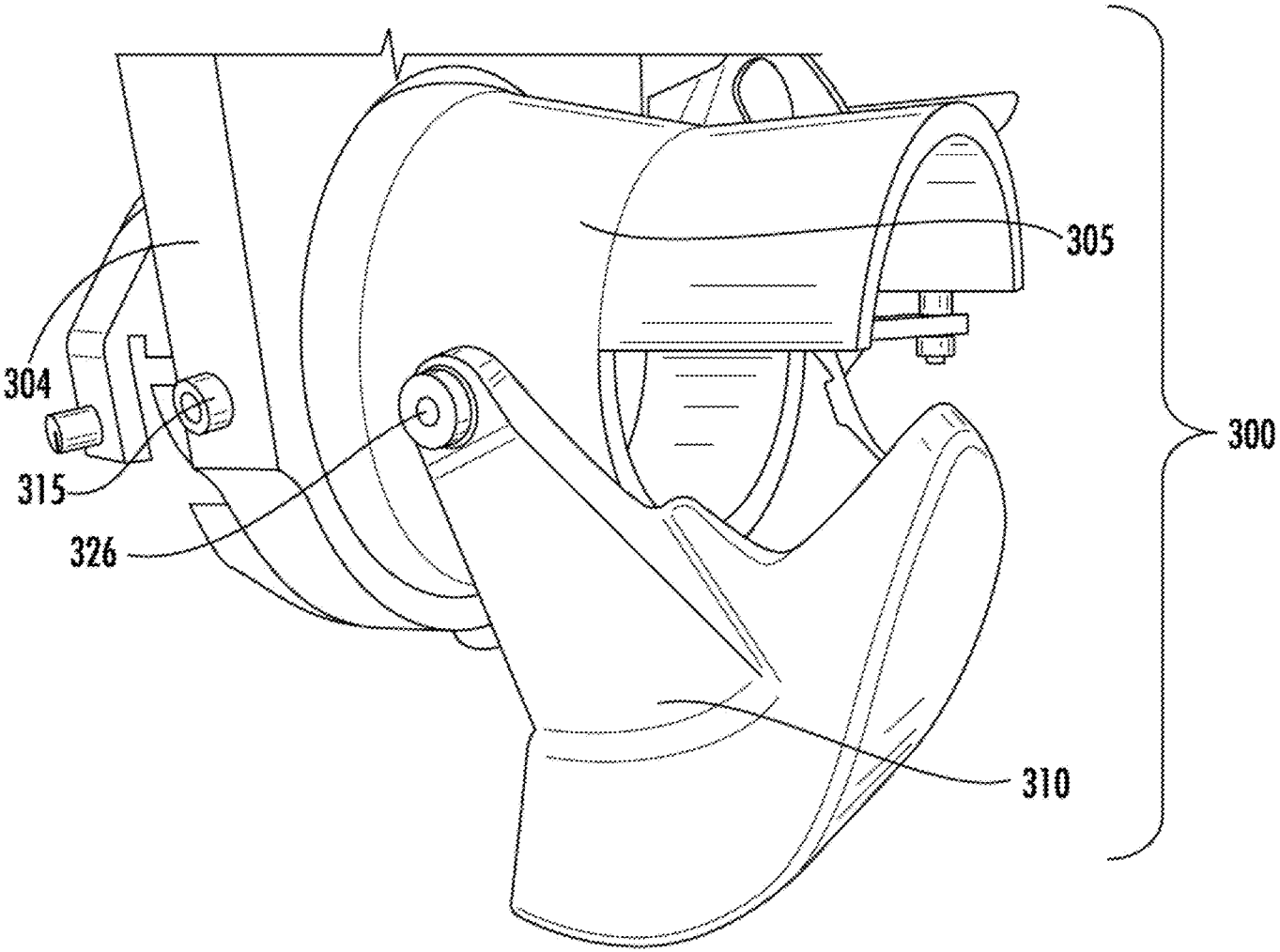
FIG. 6 is a drawing showing an embodiment of the directional mechanism as described herein, with the reversing bucket in an open, inactive position.

FIGS. 5 through 10 are additional images showing an embodiment of a directional mechanism 300 according to this disclosure. Here, directional mechanism 300 comprises an adapter 301 or conduit for fitting over the nozzle of an outboard jet motor and a steering nozzle 305. The steering nozzle can be cylindrical with slightly converging walls in the direction of the output of flow from the motor as shown in FIG. 6. Shown in FIG. 6 is an additional shroud portion extending from the converged portion of the steering nozzle. However, for this embodiment, the trim component is an outer frame 304, which is both rectilinear and curvilinear in shape, joins the adapter 301 with the steering nozzle 305 instead of the circular trim ring. The individual components will be described in additional detail below. The components of the directional mechanism 300 may be dimensioned as described above for the previous embodiment.

As shown in FIGS. 5 through 10, the adapter 301 or conduit portion has a cross-sectional shape that is substantially circular. The diameter of the adapter portion 301 can be configured to expand slightly towards the jet motor nozzle fitting end, and the adapter 301 terminates at a semi-circular bracket, which bracket terminates at two square tabs on the sides of the adapter portion. The two square tabs each have through-holes for securing the adapter to the jet motor nozzle with bolts. At the opposite end, the adapter portion 301 expands as a ring configured for fitting securely within the outer frame 304. Additionally, the adapter portion 301 has a slot on either side which extends along the length of the conduit. The slot can be used as a visual guide for ensuring the adapter portion 301 fits securely to the jet motor nozzle.

Figure 7:
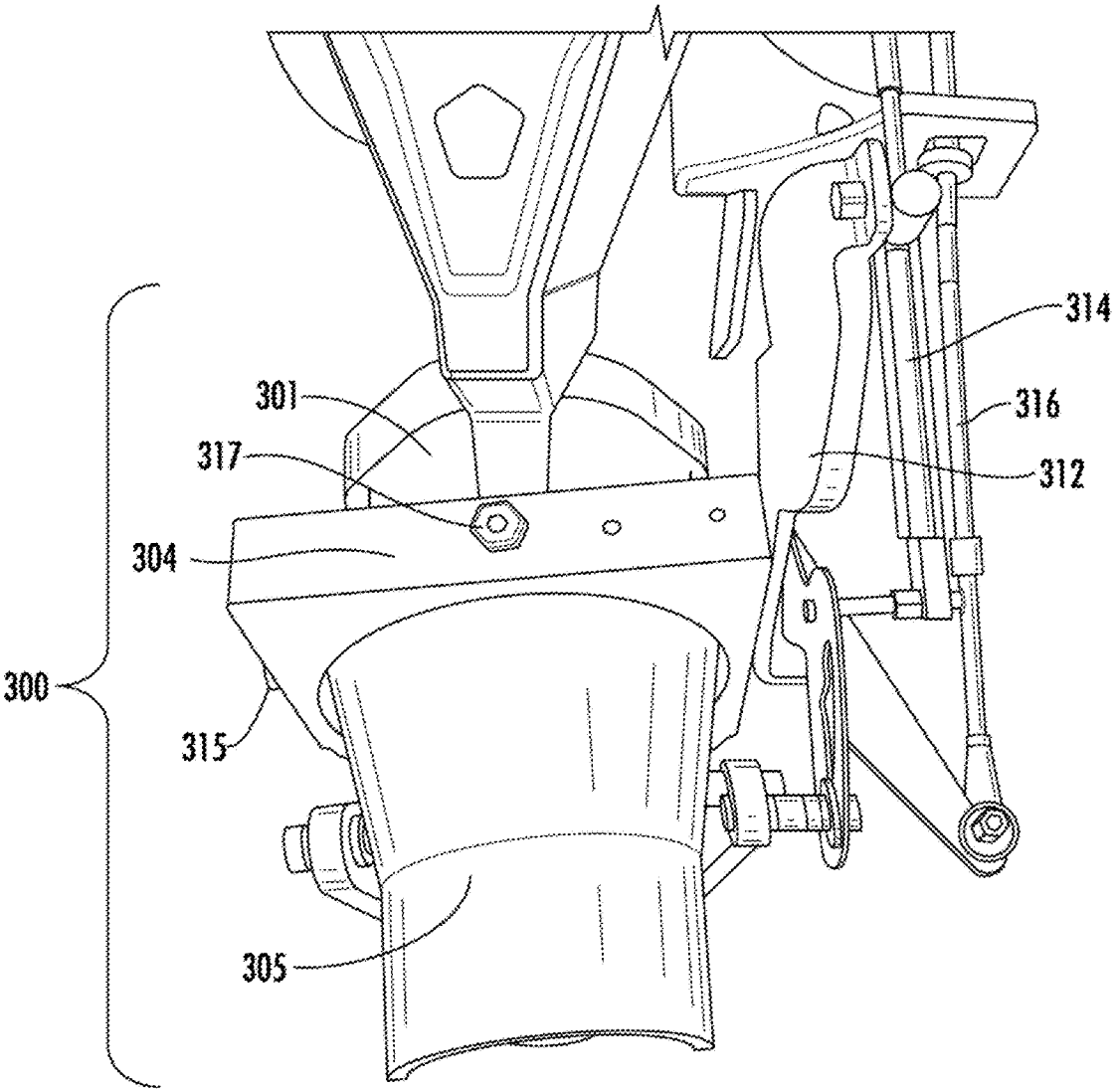
FIG. 7 is a drawing showing a top perspective view of an embodiment of the directional mechanisms as described herein.
Figure 8:
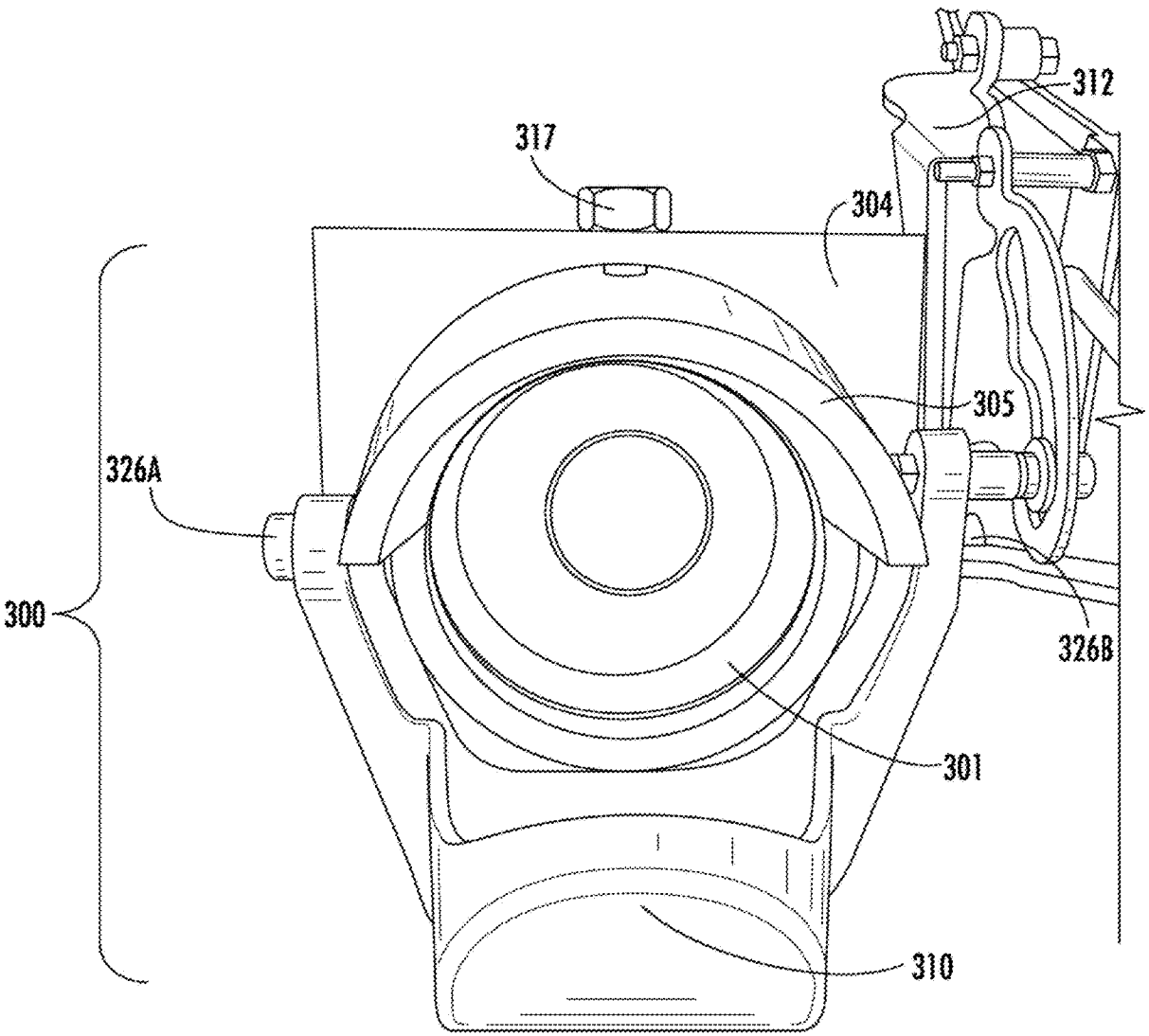
FIG. 8 is a drawing showing a front perspective view of an embodiment of the directional mechanisms as described herein.
Figure 9:
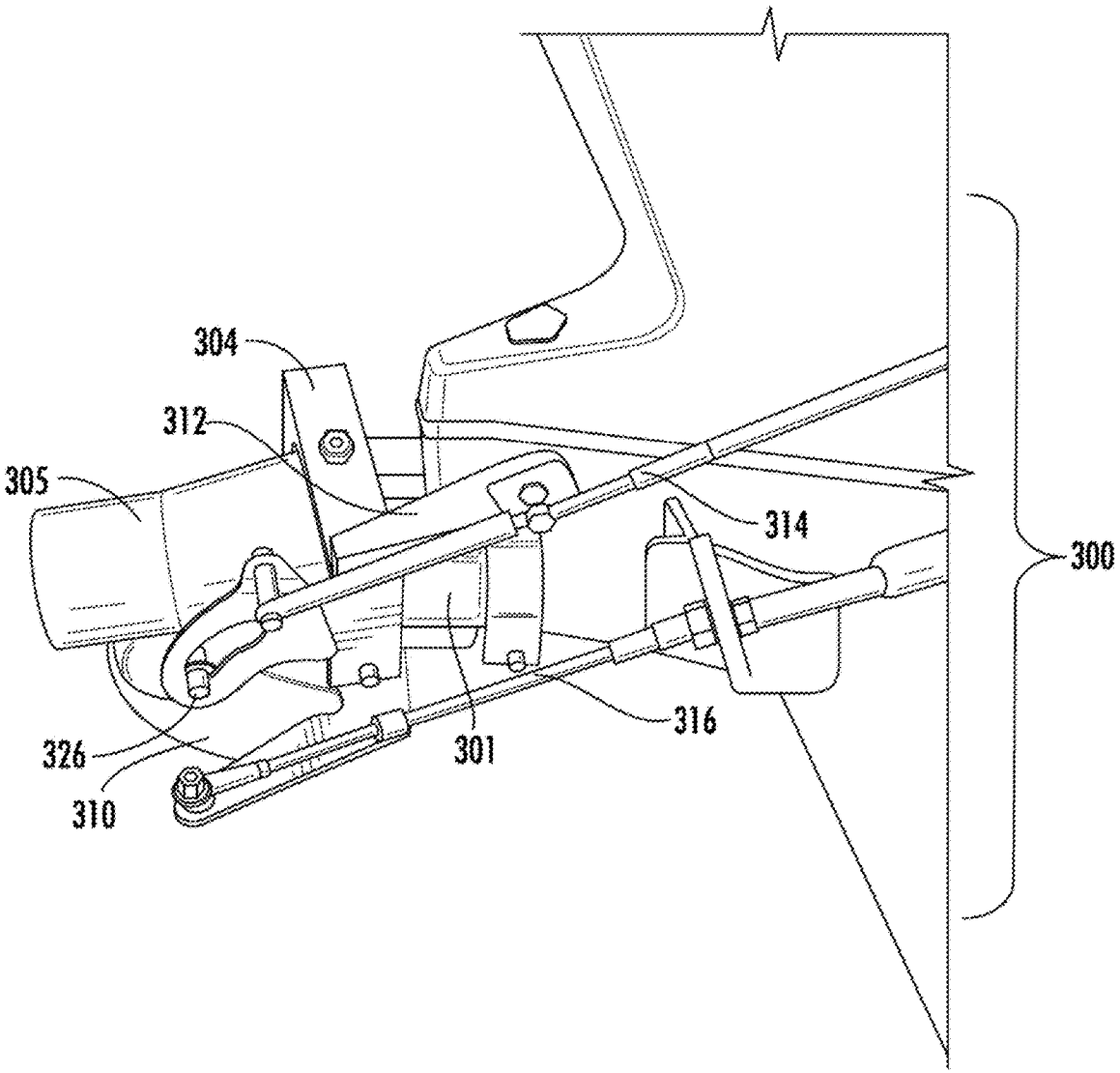
FIG. 9 is a drawing showing a side perspective view of an embodiment of the directional mechanisms as described herein.
Figure 10:
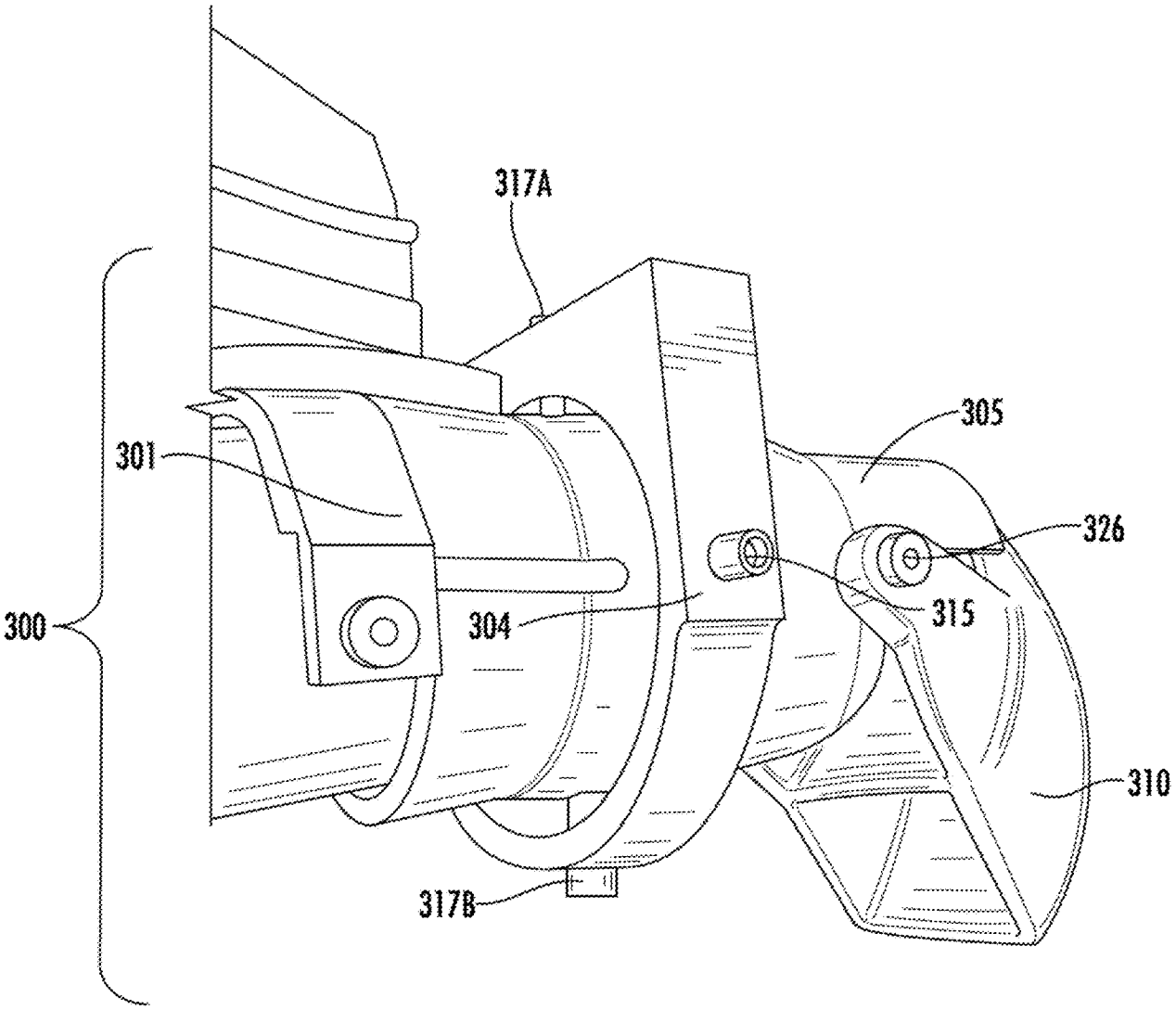
FIG. 10 is a drawing showing a rear, side perspective view of an embodiment of the directional mechanisms as described herein, with the reversing bucket in a closed, active position.

As further shown in FIGS. 5 through 10, the steering nozzle 305 of the directional mechanism 300 has a funneled cylindrical portion extending from the outer frame 304 and narrowing toward a semi-cylindrical portion which provide for an output of the directional mechanism 300. As shown in FIG. 8, the steering nozzle 305 for directing the flow of the output of the jet motor surrounds a portion of the adapter portion 301 where it extends inside the nozzle.

As further shown in FIGS. 5 through 10, the outer frame 304 is configured to join the adapter portion 301 with the steering nozzle 305 and provide a structure for securing actuator mechanisms 314, 316 to the directional mechanism 300. As shown in the figures, the outer portion of the outer frame 304 is both rectilinear and curvilinear in shape, with the top half forming the top of a square and the bottom half forming a semicircle. The inner portion of the outer frame 304 has a circular cross-sectional shape configured to fit both the adapter portion 301 and the steering nozzle portion 305. As shown in FIG. 5, the outer frame 304 has through-holes configured to fit bolts or other fasteners for securing the adapter portion 301 and steering nozzle portion 305.

A particular embodiment provides for two horizontal fasteners 315 and two vertical fasteners 317 which are in communication with the outer frame 304. In an embodiment, the horizontal fasteners 315 connect the steering nozzle 305 to the outer frame 304 and the vertical fasteners 317 connect the adapter portion 301 to the outer frame 304. The fasteners provide axes for pivoting components of the directional mechanism 300 vertically (fasteners 315) or laterally (fasteners 317) to provide for trimming and turning capabilities. In some embodiments, the two horizontal fasteners 315 are in communication with the steering nozzle 305 and provide for vertical movement of the steering nozzle 305 relative to the adapter 301, while the two vertical fasteners 317 are in communication with the adapter 301 and provide for horizontal movement of the outer frame 304 relative to the adapter 301. Alternatively, in other embodiments, the two vertical fasteners 317 may be in communication with the steering nozzle 305 and provide for horizontal movement of the steering nozzle 305 relative to the adapter 301, and the two horizontal fasteners 315 may be in communication with the adapter 301 and provide for vertical movement of the outer frame 304 relative to the adapter 301.

Additionally, as shown in FIG. 7, outer frame 304 has a mounting bracket 312 fixed on one side which provides for connection with one or more actuators 314, 316. The mounting bracket 312 has a flat middle portion which is configured to fit over the flat portion of the side of the outer frame 304 (i.e. the side of the top half of the square). The mounting bracket 312 further has a bottom portion lying in a plane that is perpendicular to flat middle portion and angled outward so that it extends away from the trim component/frame. A through-hole is present at the end of the bottom portion of the mounting bracket 312 for receiving a bolt or other fastener for securing an end of an actuator 316. The mounting bracket 312 further has a top portion lying in a plane that is perpendicular to flat middle portion (such that it is parallel to top of outer frame 304) and terminates at a tab which extends upward. The tab can be configured with a through-hole for receiving a bolt or other fastener for securing an additional actuator 314, which will be described in further detail below. In some embodiments, mounting of actuators 314, 316 may be achieved through the use of more than one bracket.

As can also be seen in FIG. 7, moving first actuator 316 forward and backward causes the outer frame 304 to pivot horizontally left and right along a vertical axis and about vertical fasteners 317, causing the directional mechanism 300 to pivot left or right and thus providing for left and right turning capability, as outer frame 304 (along with steering nozzle 305). The other end of the actuator 316 can extend inside the boat to a control panel or other control mechanism, allowing the operator to move the actuator forward or backward. While facing the directional mechanism 300 from the back of the boat, extending actuator 316 causes directional mechanism 300 to pivot left and retracting actuator causes directional mechanism 300 to pivot right. Additionally, in some embodiments, outer frame 304 (with steering nozzle 305) may be configured to pivot upward or downward along a horizontal axis. In these embodiments, the actuator 316 may be configured to be moved upward or downward such that when the operator moves their end of actuator 316 upward, the opposite end moves downward causing directional mechanism 300 to tilt downward and vice versa. Thus, these embodiments provide for upward and downward trimming capability of the directional mechanism 300.

Further shown in FIGS. 5 through 10, at the bottom of the directional mechanism 300 is a reversing bucket 310 which is attached to the funneled portion of the nozzle by two bolts 326 (or other fasteners) extending on either side. Reversing bucket 310 is configured to swing downward in an inactive or stowed position (shown in FIGS. 7 and 8) or upward into an active position (shown in FIG. 10) along a horizontal axis defined by fasteners 326. Reversing bucket 310 is configured so that when it is in the active position, one end covers or partially covers the output of the steering nozzle 305. As reversing bucket 310 is configured as a curved chute or conduit, the opposite end is configured to direct output of the jet engine to reverse in direction (i.e. be directed toward boat rather than away), which allows the operator to reverse direction of the boat. The reversing bucket 310 may be moved upward or downward through a second actuator 314 which is connected to the side of the reversing bucket 310 through a flat collar which can have a curvilinear outer shape. The flat collar has a slot for receiving an additional bolt on the side of the reversing bucket 310 and is connected perpendicularly to the second actuator through a short connecting rod, as shown in FIG. 7. Additionally, the second actuator 314 is connected to a top portion of the mounting bracket 312 at the upward projecting tab. The other end of the second actuator 314 may extend into boat into a control panel as previously described.

Figure 11C:
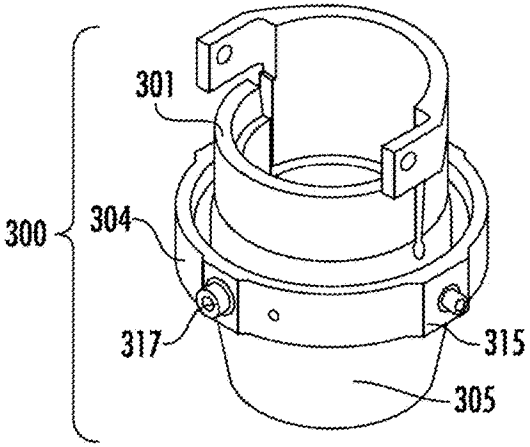
FIG. 11C is a drawing showing an isometric view of another embodiment of a directional mechanism as described herein.
Figure 11D:
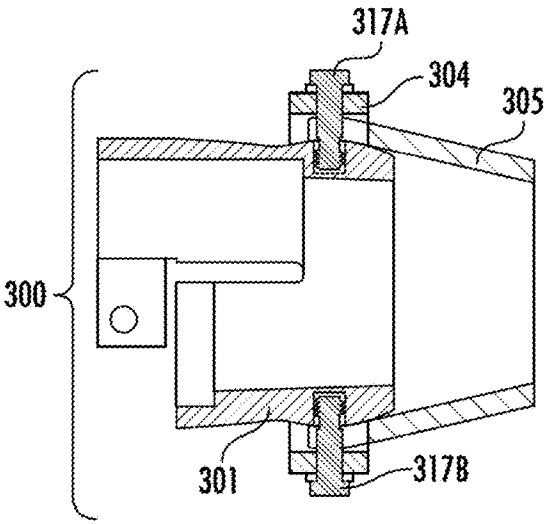
FIG. 11D is a drawing showing a section view of a directional mechanism as described herein, which is section view A-A as indicated in FIG. 11B.
Figure 11A:
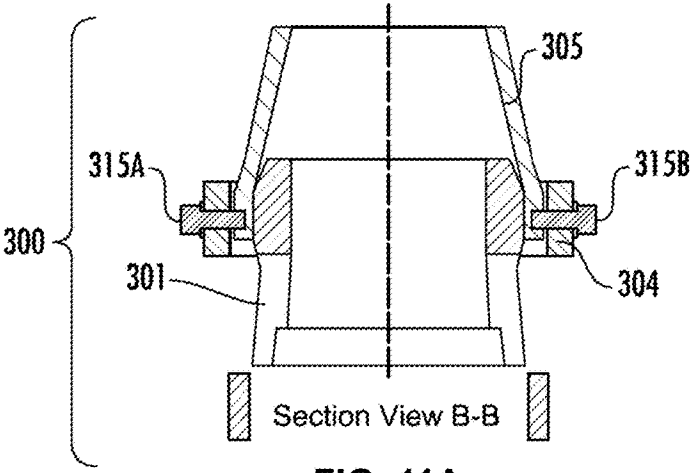
FIG. 11A is a drawing showing a section view of a directional mechanism as described herein, which is section view B-B as indicated in FIG. 11B.
Figure 11B:
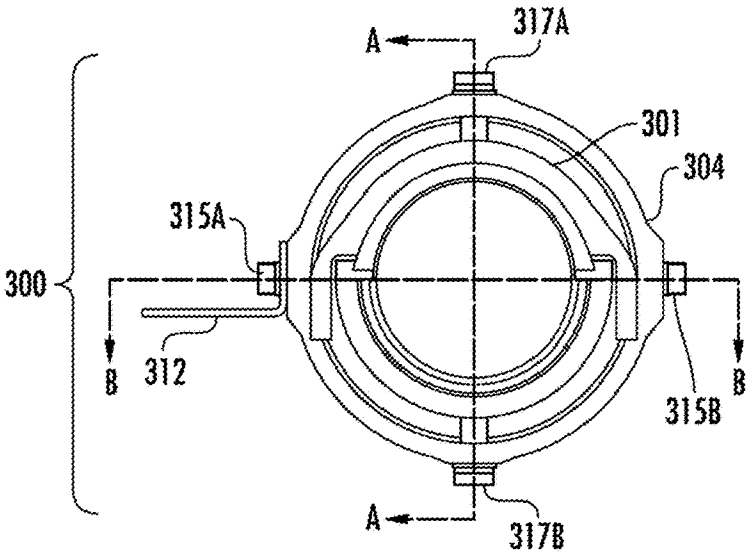
FIG. 11B is a drawing showing a front view of a directional mechanism as described herein.
Figure 12A:
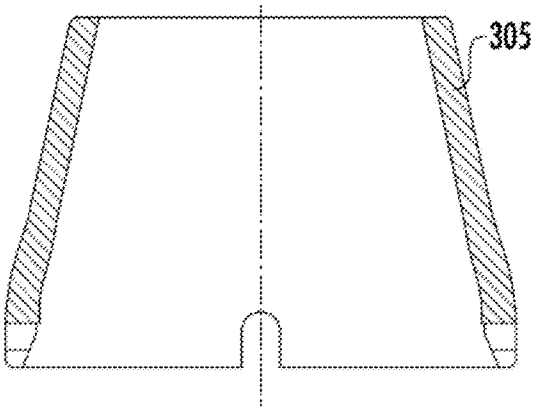
FIG. 12A is a drawing of a section view of a nozzle component of a directional mechanism as described herein, which is section view A as indicated in FIG. 12B.
Figure 12B:
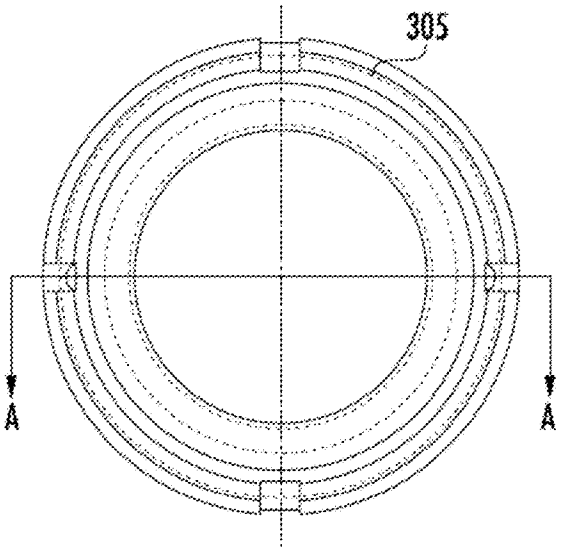
FIG. 12B is a drawing showing a front view of a nozzle component of a directional mechanism as described herein.
Figure 12C:
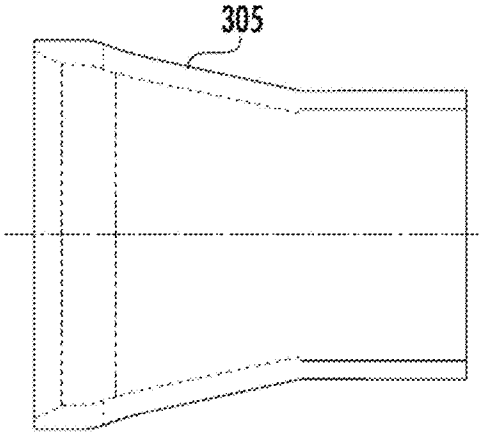
FIG. 12C is a drawing showing a section view of a nozzle component of a directional mechanism as described herein.
Figure 13B:
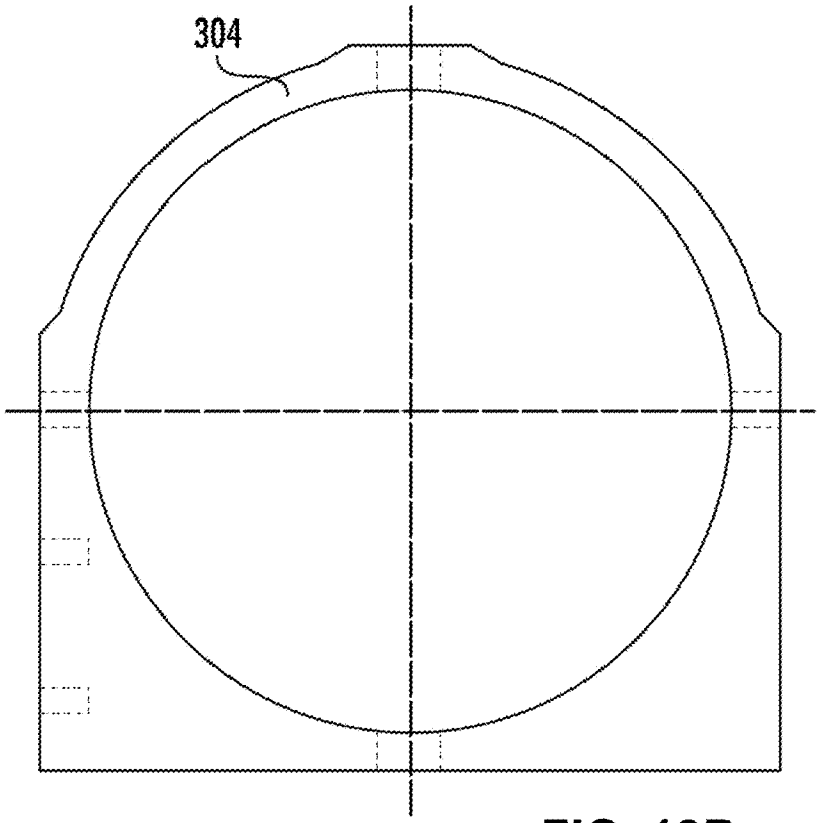
FIG. 13B is a drawing showing a front view of a ring component of a directional mechanism as described herein.
Figure 13C:
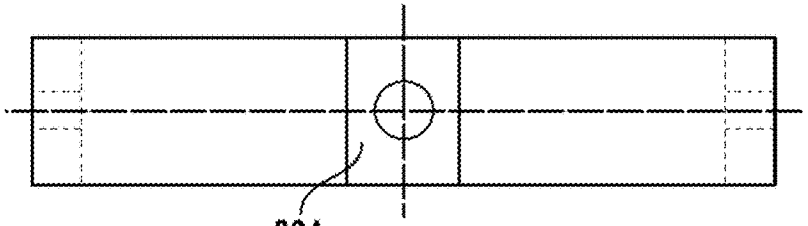
FIG. 13C is a drawing showing a bottom view of a ring component of a directional mechanism as described herein.
Figure 13A:
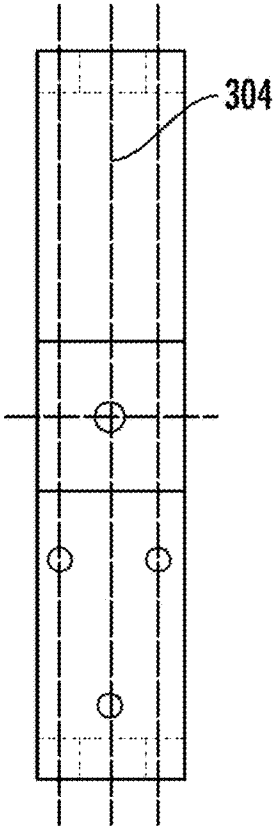
FIG. 13A is a drawing showing a side view of a ring component of a directional mechanism as described herein.
Figure 14E:
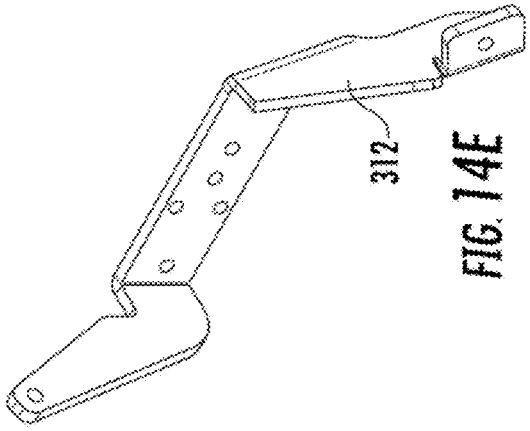
FIGS. 14A-E are drawings showing various views of a cable bracket component of a directional mechanism as described herein.
Figure 14D:
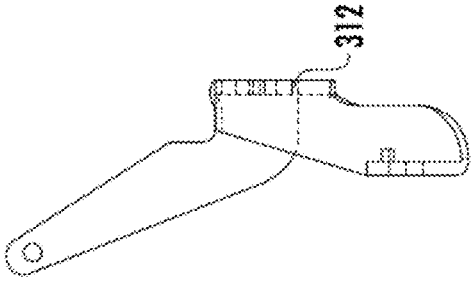
Figure 14A:
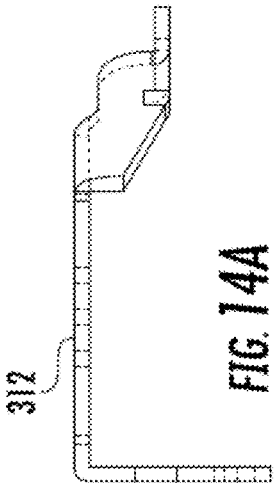
Figure 14B:
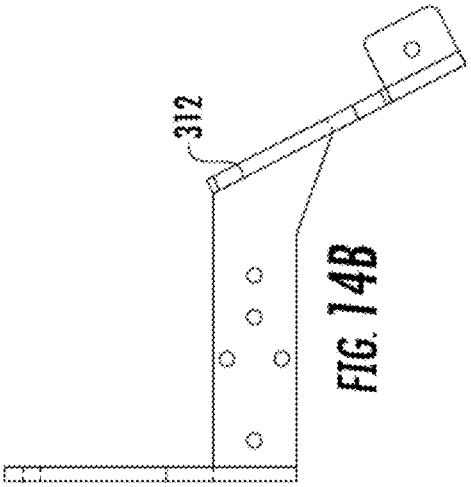
Figure 14C:
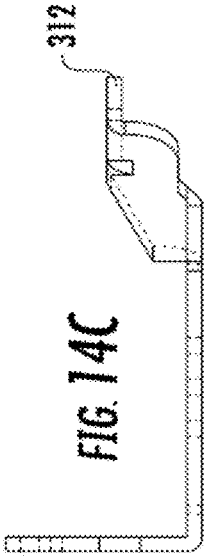
Figure 15C:
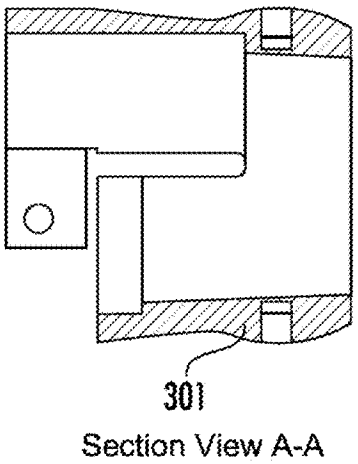
FIG. 15C is a drawing showing a section view of an adapter component of a directional mechanism as described herein.
Figure 15B:
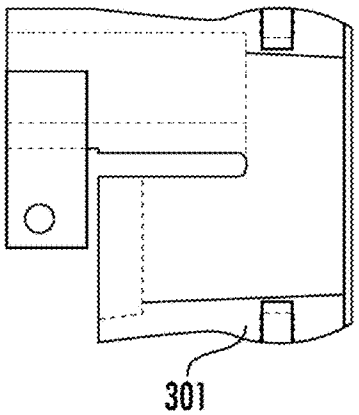
FIG. 15B is a drawing showing a side perspective view of an adapter component of a directional mechanism as described herein.
Figure 15D:
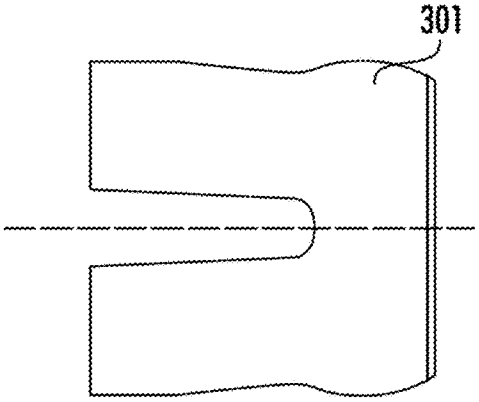
FIG. 15D is a drawing showing a top perspective view of an adapter component of a directional mechanism as described herein.
Figure 15A:
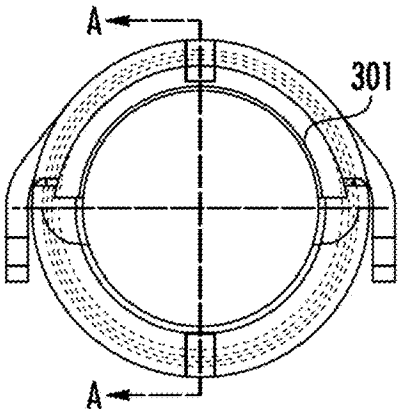
FIG. 15A is a drawing showing a front view of an adapter component of a directional mechanism as described herein.

FIGS. 11A-11D show an embodiment of the directional mechanism 300. More particularly, FIGS. 11A-11D show that the nozzle 305 is connected to an adapter 301 through a circular ring which serves as the outer frame 304 described above. The nozzle can have a generally conical shape (similar to component 205 shown in FIG. 3) and/or can have slightly converging walls that converge in the direction of flow output from the motor, i.e., the walls converge away from the boat. In embodiments, and as shown in FIG. 11D, the nozzle can comprise an additional shroud portion that extends from the converged end of the nozzle and away from the boat. As shown in FIG. 11A, a long bolt 315A and a short bolt 315B connect the circular ring to the nozzle on either side horizontally. Additionally, the long bolt 315A connects the mounting/cable bracket 312 to the outer frame 304. The mounting/cable bracket 312 has a through hole (not shown) for connecting to a cable or directly to an actuator. Further, the outer frame 304 is connected to the adapter vertically through shoulder bolts 317A and 317B. Thus, this embodiment advantageously provides for trimming (e.g. upward and downward) capability as well as left and right turning capability as bolts provide both horizontal and vertical axes for directional control.

Figure 16A:
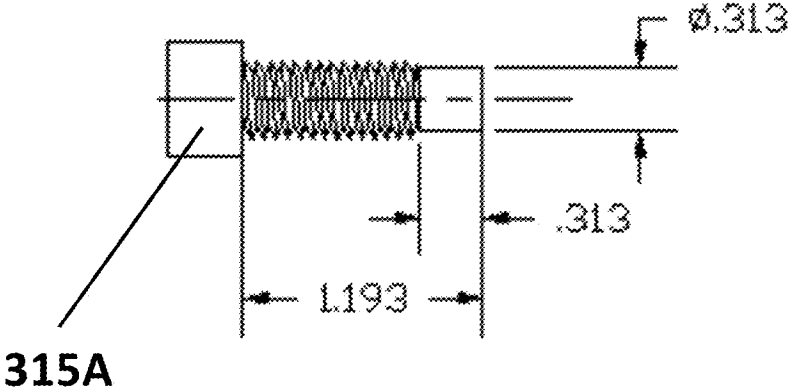
FIGS. 16A-B are drawings showing, respectively, long and short bolt components of a directional mechanism as described herein.
Figure 16B:
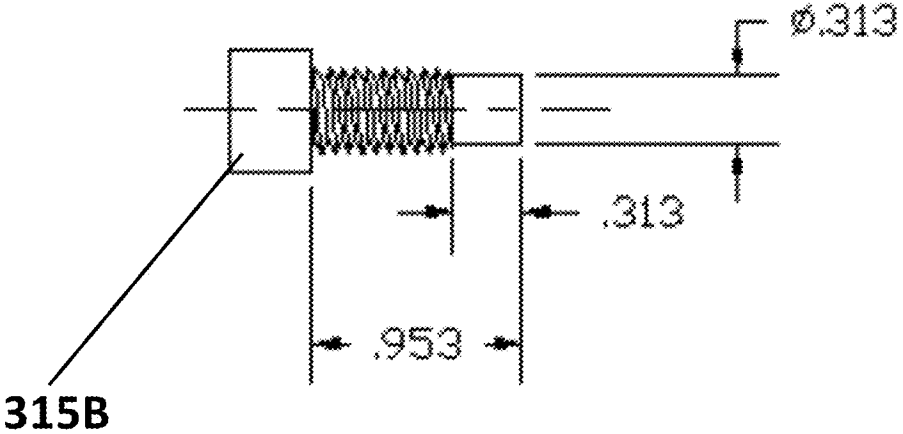
Figure 17:
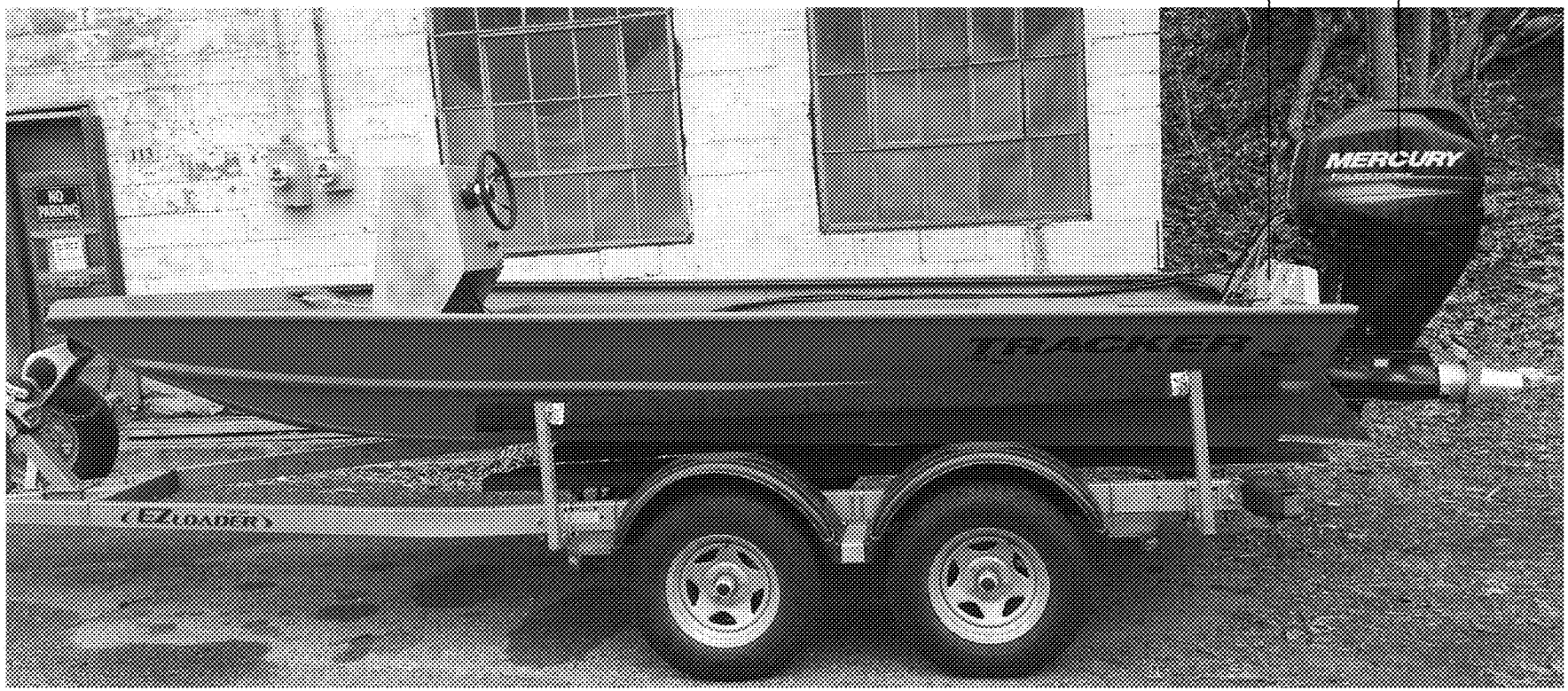
FIG. 17 is a drawing showing a side view of an acceptor device for attaching/mounting an outboard jet motor to a boat hull as described herein.

Various embodiments of the individual components of the directional mechanism are shown in FIGS. 12A through 16B, including the nozzle 305 (FIGS. 12A-12C), the outer frame or ring 304 (FIGS. 13A-13C), the mounting/cable bracket 312 (FIGS. 14A-E), the adapter 301 (FIGS. 15A-D), and a long bolt 315A (FIG. 16A) and short bolt 315B (FIG. 16B).

The present disclosure has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention. It is noted in particular that where a range of values is provided in this specification, each value between the upper and lower limits of that range is also specifically disclosed.

The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. An acceptor device for securing an outboard jet motor to a watercraft, the acceptor device comprising:

one or more shrouded opening(s) shaped and sized for communication with an intake of one or more outboard jet motor(s);

wherein the acceptor device is configured to provide the outboard jet motor intake disposed at an angle that slopes upwardly toward the watercraft; and wherein the acceptor device is configured to elevate at least a portion of the intake of the outboard jet motor above a bottom surface of the watercraft.

2. The acceptor device of claim 1, wherein the acceptor device is secured to a transom or a surface on a bottom of the watercraft, or both.

3. The acceptor device of claim 1, wherein the acceptor device is configured to restrict movement of the intake of the outboard jet motor when the outboard jet motor is mounted to the watercraft.

4. The acceptor device of claim 1, wherein the shrouded opening comprises one or more sidewalls shaped, sized, and disposed to cover gap(s) between the outboard jet motor and the acceptor device.

5. The acceptor device of claim 1, wherein the acceptor device is mounted to a bottom surface of the watercraft.

6. The acceptor device of claim 1 comprising:

a first support configured to be mounted on an upper portion of a transom of the watercraft; and a second support configured to be mounted on a lower portion of the transom;

wherein during use the first support secures a top portion and the second support secures a bottom portion of the outboard jet motor to the watercraft.

7. The acceptor device of claim 1, which is provided as a single component or as two or more components.

8. The acceptor device of claim 1:

wherein the shrouded opening(s) is shaped and sized for communication with a tunnel shaped and sized for directing a flow of water into the intake wherein the acceptor device is configured to provide the outboard jet motor intake.

9. The acceptor device of claim 1, wherein a cross section of the tunnel is parabolic, U-shaped, trapezoidal, polygonal, triangular, square, rectangular, pentagonal, hexagonal, or octagonal.

10. The acceptor device of claim 8, wherein the tunnel:

is configured to slope upwardly from a first end to a second end of the tunnel;

and has a depth that increases from the first end to the second end of the tunnel.

11. An acceptor device for securing an outboard jet motor to a watercraft, the acceptor device comprising:

one or more shrouded opening(s) shaped and sized for communication with an intake of one or more outboard jet motor(s) and comprising one or more sidewalls shaped, sized, and disposed in to cover gap(s) between the outboard jet motor and the acceptor device;

wherein the acceptor device is configured to provide the intake of the outboard jet motor disposed at an angle that slopes upwardly toward the watercraft; and wherein the acceptor device is configured to elevate at least a portion of the intake of the outboard jet motor above a bottom surface of the watercraft.

12. The acceptor device of claim 11 comprising:

a first support configured to be mounted on an upper portion of a transom of the watercraft; and a second support configured to be mounted on a lower portion of the transom;

wherein during use the first support secures a top portion and the second support secures a bottom portion of the outboard jet motor to the watercraft.

13. The acceptor device of claim 11, wherein the acceptor device is configured to receive a flow of water from a tunnel with a surface that slopes upwardly toward the intake of the outboard jet motor.

14. The acceptor device of claim 13, wherein the tunnel is configured to slope upwardly from a first end to a second end of the tunnel at an angle between 5 and 45 degrees.

15. An acceptor device for securing an outboard jet motor to a watercraft, the acceptor device comprising:

one or more shrouded opening(s) shaped and sized for communication with an intake of one or more outboard jet motor(s);

wherein the acceptor device is configured to provide the outboard jet motor intake disposed at an angle that slopes upwardly toward the watercraft;

wherein the shrouded opening is configured for communication with a tunnel for directing a flow of water into the intake of the outboard jet motor during use; and wherein the tunnel is configured to be disposed behind the watercraft.

16. A boat hull comprising:

a transom for supporting an outboard jet motor;

a tunnel disposed in a bottom surface of the hull and extending to the transom; and an adapter disposed where the transom and the tunnel meet, the adapter comprising a shrouded opening for communication with the outboard jet motor at an intake of the outboard jet motor;

wherein the tunnel is configured for directing a flow of water through the tunnel, into the adapter, and into the intake of the outboard jet motor; and wherein the adapter is configured to provide the outboard jet motor intake disposed at an angle that slopes upwardly toward the tunnel.

17. The boat hull of claim 16, wherein:

the tunnel comprises a front end that merges with a bottom surface of the hull and a back end that terminates at the transom; and the tunnel slopes upwardly at an angle from the front end of the tunnel to the back end of the tunnel.

18. The boat hull of claim 16, wherein:

the tunnel comprises a front end that merges with a bottom surface of the hull and a back end that terminates at the transom; and the tunnel slopes upwardly from the front end of the tunnel to the back end of the tunnel at an angle between about 5 degrees and about 45 degrees.

19. The boat hull of claim 18, wherein the depth of the tunnel increases from the front end of the tunnel to the back end of the tunnel.

20. The boat hull of claim 18, wherein the tunnel has a width that is wider at the front end of the tunnel than at the back end of the tunnel.

* * * * *